US007607753B2

(12) United States Patent
Yogi et al.

(10) Patent No.: US 7,607,753 B2
(45) Date of Patent: Oct. 27, 2009

(54) LIQUID DROPLET FORMING METHOD AND LIQUID DROPLET FORMING DEVICE

(75) Inventors: Osamu Yogi, Hamamatsu (JP); Tomonori Kawakami, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 191 days.

(21) Appl. No.: 11/660,350

(22) PCT Filed: Aug. 12, 2005

(86) PCT No.: PCT/JP2005/014845

§ 371 (c)(1),
(2), (4) Date: Jun. 21, 2007

(87) PCT Pub. No.: WO2006/019057

PCT Pub. Date: Feb. 23, 2006

(65) Prior Publication Data

US 2007/0273718 A1 Nov. 29, 2007

(30) Foreign Application Priority Data

Aug. 20, 2004 (JP) ..... 2004-241589

(51) Int. Cl.
*B41J 29/393* (2006.01)

(52) U.S. Cl. ..... 347/19; 347/10

(58) Field of Classification Search ..... 347/5, 347/9–12, 19

See application file for complete search history.

(56) References Cited

U.S. PATENT DOCUMENTS 3,060,429 A 10/1962 Winston
4,160,257 A 7/1979 Carrish
4,263,601 A 4/1981 Nishimura et al.

(Continued)

FOREIGN PATENT DOCUMENTS

DE 29 49 808 7/1980

(Continued)

OTHER PUBLICATIONS

0. Yogi et al., "Mixture of Minute Solutions in a pl Order Droplet by use of Electrostatic Force," Proceedings of 2002 Annual Meeting of The Institute of Electrostatics Japan, Aug. 29-30, 2002, pp. 151-154.

(Continued)

*Primary Examiner*—Lamson D Nguyen
(74) *Attorney, Agent, or Firm*—Drinker Biddle & Reath LLP

(57) ABSTRACT

A droplet forming method, for forming a droplet 27, constituted of a sample liquid 21, on a substrate 5 by applying a pulse voltage P between the sample liquid 21, retained in a nozzle 3, and the substrate 5, disposed opposite a tip of the nozzle 3, to discharge the sample liquid 21 from the tip of the nozzle 3, includes: a waveform measuring step S1 of measuring a temporal waveform of a current I that flows between the sample liquid 21 in the nozzle 3 and the substrate 5; and an application condition determining step S2 of determining, based on the temporal waveform of the current I, an application condition of the pulse voltage P during the forming of the droplet 27 on the substrate 5.

12 Claims, 16 Drawing Sheets

U.S. PATENT DOCUMENTS

| | | | | |
|---|---|---|---|---|
| 4,346,387 | A | 8/1982 | Hertz | |
| 4,621,268 | A | 11/1986 | Keeling et al. | |
| 5,528,046 | A | 6/1996 | Ishikawa | |
| 5,560,543 | A | 10/1996 | Smith et al. | |
| 5,813,614 | A | 9/1998 | Coffee | |
| 5,856,836 | A | 1/1999 | Silverbrook | |
| 5,965,446 | A | 10/1999 | Ishikawa | |
| 6,200,013 | B1 | 3/2001 | Takeuchi et al. | |
| 6,242,266 | B1 | 6/2001 | Schleifer et al. | |
| 6,252,129 | B1 | 6/2001 | Coffee | |
| 6,764,720 | B2 | 7/2004 | Pui et al. | |
| 6,811,090 | B2 | 11/2004 | Yogi et al. | |
| 7,261,386 | B2 * | 8/2007 | Hung | 347/14 |
| 7,267,420 | B2 * | 9/2007 | Yagi | 347/19 |
| 7,407,249 | B2 * | 8/2008 | Jeong | 347/15 |

FOREIGN PATENT DOCUMENTS

| | | |
|---|---|---|
| EP | 0 673 895 | 9/1995 |
| EP | 1 205 252 | 5/2002 |
| JP | 55-079175 | 6/1980 |
| JP | 60-090853 | 5/1985 |
| JP | 62-143844 | 6/1987 |
| JP | 63-129034 | 6/1988 |
| JP | 63-129035 | 6/1988 |
| JP | 64-042140 | 2/1989 |
| JP | 64-0169146 | 3/1989 |
| JP | 04-039045 | 2/1992 |
| JP | 06-148076 | 5/1994 |
| JP | 08-066652 | 3/1996 |
| JP | 08-207318 | 8/1996 |
| JP | 9-123460 | 5/1997 |
| JP | 2783209 | 5/1998 |
| JP | 10-185782 | 7/1998 |
| JP | 2885716 | 4/1999 |
| JP | 11-198383 | 7/1999 |
| JP | 11-300975 | 11/1999 |
| JP | 2000-111477 | 4/2000 |
| JP | 2000-313162 | 11/2000 |
| JP | 2001-38911 | 2/2001 |
| JP | 2001-116750 | 4/2001 |
| WO | WO 99/03790 | 1/1999 |
| WO | WO 99/54730 | 10/1999 |
| WO | WO 01/08808 | 2/2001 |
| WO | WO 03/010418 | 2/2003 |
| WO | 03/020418 | 3/2003 |

OTHER PUBLICATIONS

Extended Abstracts (The 50$^{th}$ Spring Meeting, 2003): The Japan Society of Applied Physics and Related Societies, Mar. 27, 2003, p. 1299.

O. Yogi et al., "Mixing minute solutions in a picoliter order droplet using electrostatic force," Bitrel 2002, Proceedings of International Symposium on Bio-Trace Elements 2002, Oct. 28-31, 2002, Oct. 31-Nov. 2, 2002, pp. 37-38.

O. Yogi et al., "Mixing Minute Solutions in a Picoliter Order Droplet using Electrostatic Force," Proceedings of the 7$^{th}$ International Conference on Properties and Applications of Dielectric Materials, Jun. 1-5, 2003, pp. 1043-1046.

E. Litborn et al., "Parallel reactions in open chip-based nanovials with continuous compensation for solvent evaporation," Electrophoresis, 2000, vol. 21, pp. 91-99.

D. Shalon, et al., "A DNA Microarray System for Analyzing Complex DNA Samples Using Two-color Fluorescent Probe Hybridization," Genome Research, 1996, vol. 6, No. 7, pp. 639-645.

* cited by examiner

LIQUID DROPLET FORMING METHOD AND LIQUID DROPLET FORMING DEVICE

TECHNICAL FIELD

The present invention relates to a droplet forming method and a droplet forming device for forming droplets as desired on a substrate.

BACKGROUND ART

Droplet forming methods making use of electrostatic force are known as arts for dispensing minute amounts of liquid and forming droplets. For example, Patent Documents 1 and 2 disclose arts for forming droplets by applying a pulse voltage between a substrate disposed across a predetermined distance from a nozzle tip, and a liquid, inside the nozzle, to draw out the liquid from the nozzle tip. Of these, in the Patent Document 1, it is described that the volume of the droplet can be controlled by controlling the pulse height of the pulse voltage applied between the liquid inside the nozzle and the substrate. In the Patent Document 2, it is described that the volume of the droplet can be controlled by controlling the pulse height of the pulse voltage, a pulse width of the pulse voltage, or the distance between the nozzle tip and the substrate.

Also, Patent Document 3 discloses an inkjet recording device that uses electrostatic force. In this Patent Document 3 is disclosed an art for controlling a pulse height, pulse width, pulse frequency, etc. of a pulse voltage, applied to a discharge electrode inside a nozzle, on the basis of ink characteristics (toner concentration).

Patent Document 1: Japanese Published Unexamined Patent Application No. 2001-038911

Patent Document 2: International Patent Publication Pamphlet No. 03/020418

Patent Document 3: Patent Publication No. 2885716

DISCLOSURE OF THE INVENTION

Problem to be Solved by the Invention

When forming a droplet of minute amount by using electrostatic force, in order to stabilize a volume of the droplet, voltage application conditions such as a distance between a nozzle tip and a substrate, a pulse height of a pulse voltage, a pulse width of the pulse voltage, etc. must be optimized according to such characteristics as viscosity, conductivity, etc. of a liquid to be dispensed. However, this task requires much time and skilled labor. Also, in a case where the liquid has a comparatively high conductivity, the behavior of the liquid tends to be unstable and thus more time and labor are required. The art of Patent Document 3 is a method for controlling the voltage application conditions according to toner concentration, which changes with time, and thus the optimal voltage application conditions must be determined according to toner concentration in advance and do not enable the abovementioned voltage application conditions optimization task to be avoided.

The present invention has been made in view of the above issues, and an object thereof is to provide a droplet forming method and a droplet forming device for droplet formation using electrostatic force that enable an application condition of a voltage that is applied between a liquid inside a nozzle and a substrate to be optimized readily to form a droplet.

Means for Solving the Problem

In order to achieve the above object, the present invention provides in a droplet forming method having a droplet forming step of applying a pulse voltage between a liquid retained in a nozzle, and a substrate disposed opposite a tip of the nozzle, to discharge the liquid retained inside the nozzle from the tip of the nozzle and form a droplet on the substrate, a droplet forming method including: a waveform measuring step of measuring, in the droplet forming step, a temporal waveform of a current that flows between the liquid retained in the nozzle, and the substrate; and an application condition determining step of determining an application condition of the pulse voltage in the droplet forming step based on the temporal waveform of the current measured in the waveform measuring step.

When a pulse voltage is applied between the liquid retained in the nozzle and the substrate, the liquid is drawn from the nozzle tip by an electrostatic force and a portion of the liquid moves onto the substrate, thereby forming a droplet. Here, the behavior of the liquid at the nozzle tip during the formation of the droplet on the substrate varies according to the application condition of the pulse voltage. The present inventors found that the behavior of the liquid at the nozzle tip during the formation of the droplet on the substrate can be ascertained from the temporal waveform of the current that flows between the liquid and the substrate.

That is, with the above-described droplet forming method, by determining, in the application condition determining step, the application condition of the pulse voltage based on the temporal waveform of the current that flows between the liquid and the substrate, the application condition of the pulse voltage applied between the liquid and the substrate can be optimized readily.

The application condition of the pulse voltage determined in the application condition determining step, may include at least one of a distance between the tip of the nozzle and the substrate, a pulse height of the pulse voltage, and a time width of the pulse voltage. The behavior of the liquid during formation of the droplet on the substrate can thereby controlled favorably and the droplet amount in each dispensation can be adjusted readily.

In the application condition determining step, the application condition of the pulse voltage may be determined based on an occurrence frequency of current pulse waveforms contained in the temporal waveform of the current that is measured. The present inventors found that a plurality of current pulse waveforms are contained in the temporal waveform of the current that flows between the liquid and the substrate when the liquid moves from the nozzle tip and furthermore that the higher the occurrence frequency of the current pulse waveforms (that is, the greater the number of current pulse waveforms per unit time), the more stable the droplet amount per dispensation. By this droplet forming method, the behavior of the liquid during the forming of a droplet on the substrate can be controlled favorably and the droplet amount per dispensation can be stabilized readily.

In the application condition determining step, the application condition of the pulse voltage may be determined based on a pulse height of the current pulse waveforms contained in the temporal waveform of the current that is measured. The present inventors found that the lower the pulse height of the current pulse waveforms included in the temporal waveform of the current that flows between the liquid and the substrate (that is, the lower the current values of the current pulse waveforms), the more stable the droplet amount per dispensation. Thus by this droplet forming method, the behavior of the liquid during the forming of a droplet on the substrate can be controlled favorably and the droplet amount per dispensation can be stabilized readily. As the pulse height of the current pulse waveforms, for example, an average value of the respective pulse heights of the plurality of current waveforms may be used.

A volume measuring step of measuring a volume of the droplet based on an integration value of the temporal waveform of the current measured in the waveform measuring step may furthermore be included.

The current that flows between the liquid inside the nozzle and the substrate is caused by movement of the liquid inside the nozzle to the substrate. Thus by integrating the temporal waveform of this current (that is, by determining the amount of charges moving from the liquid inside the nozzle to the substrate), the volume of the droplet can be measured readily and with high precision. The measured volume may be output, or feedback control according to the measured volume, etc. may be performed.

The liquid retained in the nozzle may be a particle suspension, and a particle number measuring step of measuring a number of particles contained in the droplet based on the temporal waveform of the measured current may furthermore be included.

The present inventors found that when the particle suspension retained in the nozzle moves from the nozzle tip onto the substrate, the temporal waveform of the current that flows between the particle suspension and the substrate varies at instances at which an individual particle moves. Thus by observing this variation of the temporal waveform of the current, the number of particles moving from the nozzle onto the substrate can be measured. In the particle number measuring step, because the number of particles contained in the droplet is measured based on the temporal waveform of the current, the number of particles contained in the droplet can be measured readily and with high precision.

In the particle number measuring step, the number of particles contained in the droplet may be calculated based on the number of current pulse waveforms, which have a pulse width longer than a predetermined value among the current pulse waveforms contained in the temporal waveform of the measured current. The present inventors found that, during transfer of the particle mixture, retained in the nozzle, from the nozzle tip onto the substrate, the pulse width of a current pulse waveform, generated at the instant at which a single particle moves from the nozzle tip onto the substrate, is longer in comparison to that when there is no movement of particles. In the above-described particle number measuring step, because the number of particles contained in the droplet is calculated based on the number of current pulse waveforms having a pulse width longer than the predetermined value, the number of particles contained in the droplet can be measured at a higher precision.

Meanwhile, the present invention also provides a droplet forming device including: a nozzle retaining a liquid; a platform on which a substrate is set at a position opposing a tip of the nozzle; a voltage applying means applying a pulse voltage between the liquid retained in the nozzle and the substrate; and a current measuring means measuring a temporal waveform of a current, which flows between the liquid retained in the nozzle, and the substrate according to the applied pulse voltage. The above-described droplet forming method can thereby be put to practice favorably.

Preferably, the droplet forming device furthermore includes a moving means that varies a relative position of the nozzle tip and the substrate. The task of changing the distance between the nozzle tip and the substrate among the application conditions of the pulse voltage is thereby facilitated.

Furthermore, an application voltage determining means that determines, on the basis of the temporal waveform of the current measured by the current measuring means, an application condition of the pulse voltage applied by the voltage applying means in a process of forming a droplet on the substrate is preferably included. The task of determining the application condition of the pulse voltage is thereby facilitated.

Furthermore, an analyzing means, analyzing the temporal waveform of the current measured by the current measuring means and determining at least one of an occurrence frequency and a pulse height of current pulse waveforms contained in the temporal waveform, is preferably included. Furthermore, an application voltage determining means that determines, on the basis of an analysis result of the analyzing means, an application condition of the pulse voltage applied by the voltage applying means in a process of forming a droplet on the substrate is preferably included. The application condition of the pulse voltage can thereby be determined based on either the occurrence frequency or the pulse height of the plurality of current pulse waveforms contained in the temporal waveform of the current.

EFFECT OF THE INVENTION

With the droplet forming method and the droplet forming device according to the present invention, the application condition of the voltage applied between the liquid inside the nozzle and the substrate can be optimized readily in droplet forming using electrostatic force. Furthermore, by the volume of the dispensed droplet and the number of particles contained in the droplet being measured readily and with high precision, the forming of droplets with the desired characteristics on the substrate is enabled.

DESCRIPTION OF THE REFERENCE NUMERALS

Figure 1:
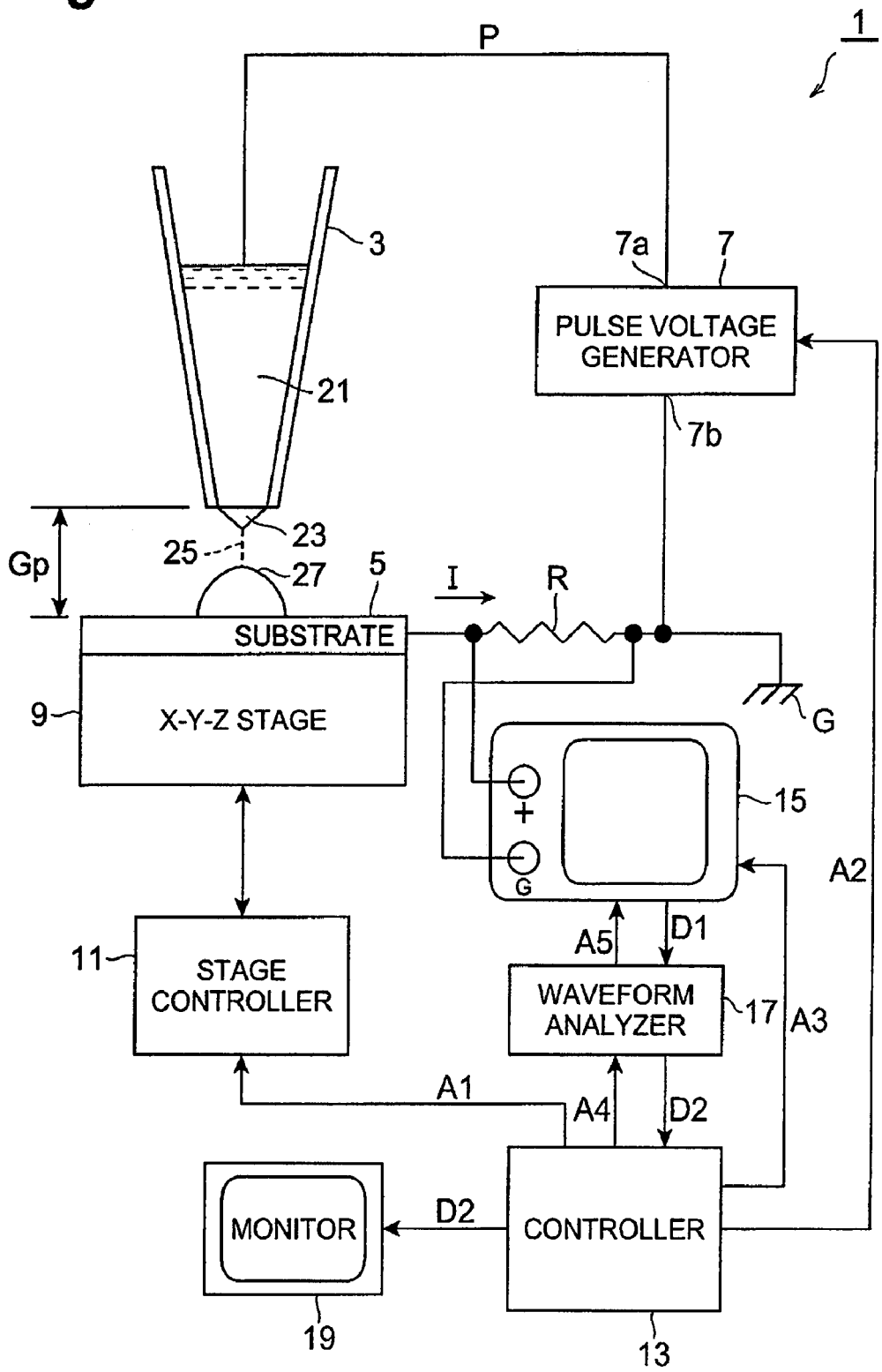
[FIG. 1] is a block diagram of an arrangement of an embodiment of a droplet forming device.

1 droplet forming device
3 nozzle
5 substrate
7 pulse voltage generator
9 XYZ stage
11 stage controller
13 controlling device
15 oscilloscope
17 waveform analyzer
19 monitor
21 sample liquid
23 Taylor cone
25 jet stream
27 droplet
G reference potential line
R resistor
S1 waveform measuring step
S2 application condition determining step

BEST MODES FOR CARRYING OUT THE INVENTION

Preferred embodiments according to the present invention shall now be described in detail with reference to the attached drawings. In the respective drawings, components that are the same shall be provided as much as possible with the same reference numbers and redundant description shall be omitted.

First Embodiment

FIG. 1 is a block diagram of an arrangement of a first embodiment of a droplet forming device according to the present invention. The droplet forming device 1 according to this embodiment includes a nozzle 3 that retains a sample liquid 21, which is a liquid, in its interior, an XYZ stage 9 that is a platform for setting a substrate 5, on a surface of which a droplet 27 is formed, and a pulse voltage generator 7.

As the sample liquid 21, for example, a 3×SSC solution, which is a saline-sodium citrate (SSC) buffer solution, used for DNA sample preparation, is used. The 3×SSC solution has a resistivity of 15Ω·cm and thus has an extremely high conductivity in comparison to pure water (18.3MΩ·cm).

Figure 2:
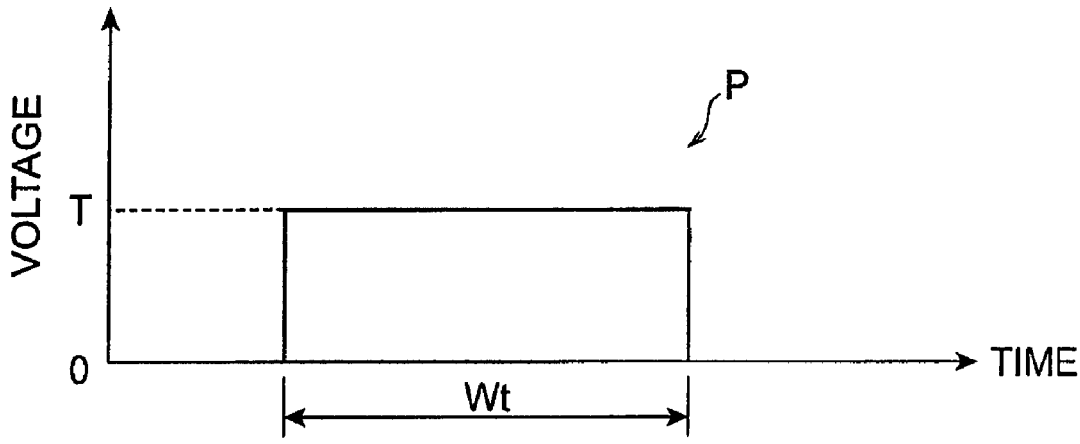
[FIG. 2] is a diagram of a waveform of a pulse voltage generated by a pulse voltage generator.

The pulse voltage generator 7 generates a pulse voltage P with a time width Wt and a pulse height T as shown in FIG. 2. On the XYZ stage 9, the substrate 5 is set so that a tip of the nozzle 3 and the substrate 5 oppose each other. This XYZ stage 9 serves in common as a moving means that varies relative positions of the tip of the nozzle 3 and the substrate 5 and can move the substrate 5 in a direction (Z direction) perpendicular to the surface of the substrate 5 and in two mutually orthogonal directions (X direction and Y direction) that are parallel to the surface of the substrate 5.

Also as a current measuring means for measuring a temporal waveform of a current I that flows between the sample liquid 21 and the substrate 5 in accordance with the pulse voltage P, the droplet forming device 1 includes a resistor R, for converting the current I, flowing between the sample liquid 21 retained in the nozzle 3, and the substrate 5 to a voltage, and an oscilloscope 15 acquiring the temporal waveform of the current I by measuring the voltage between respective ends of the resistor R.

The droplet forming device 1 also includes a waveform analyzer 17 that analyzes the temporal waveform of the current I. The waveform analyzer 17 is an analyzing means for analyzing the temporal waveform of the current I measured by the oscilloscope 15 and can determine an occurrence frequency and an average pulse height of a plurality of current pulse waveforms contained in the temporal waveform of the current I. The waveform analyzer 17 serves in common as an application voltage determining means that determines application conditions of the pulse voltage P based on the temporal waveform of the current I and determines the optimal pulse voltage P based on the occurrence frequency and the average pulse height of the plurality of current pulse waveforms contained in the temporal waveform of the current I. The droplet forming device 1 furthermore includes a stage controller 11 controlling the XYZ stage 9; a monitor 19 displaying the results of analysis of the temporal waveform of the current I; and a controller 13 controlling the pulse voltage generator 7, the stage controller 11, and the waveform analyzer 17 in a mutually coupled manner and transmitting analysis data of the temporal waveform of the current I to the monitor 19.

The substrate 5 is positioned with its surface opposing the tip of the nozzle 3. The sample liquid 21 retained in the nozzle 3 is made electrically continuous to a positive terminal 7*a* of the pulse voltage generator 7, and the substrate 5 is electrically connected to a negative terminal 7*b* of the pulse voltage generator 7 via the resistor R. The negative terminal 7*b* of the pulse voltage generator 7 is also grounded to a reference potential line G. By this arrangement, the pulse voltage P from the pulse voltage generator 7 is applied between the sample liquid 21 retained in the nozzle 3, and the substrate 5.

Figure 3:
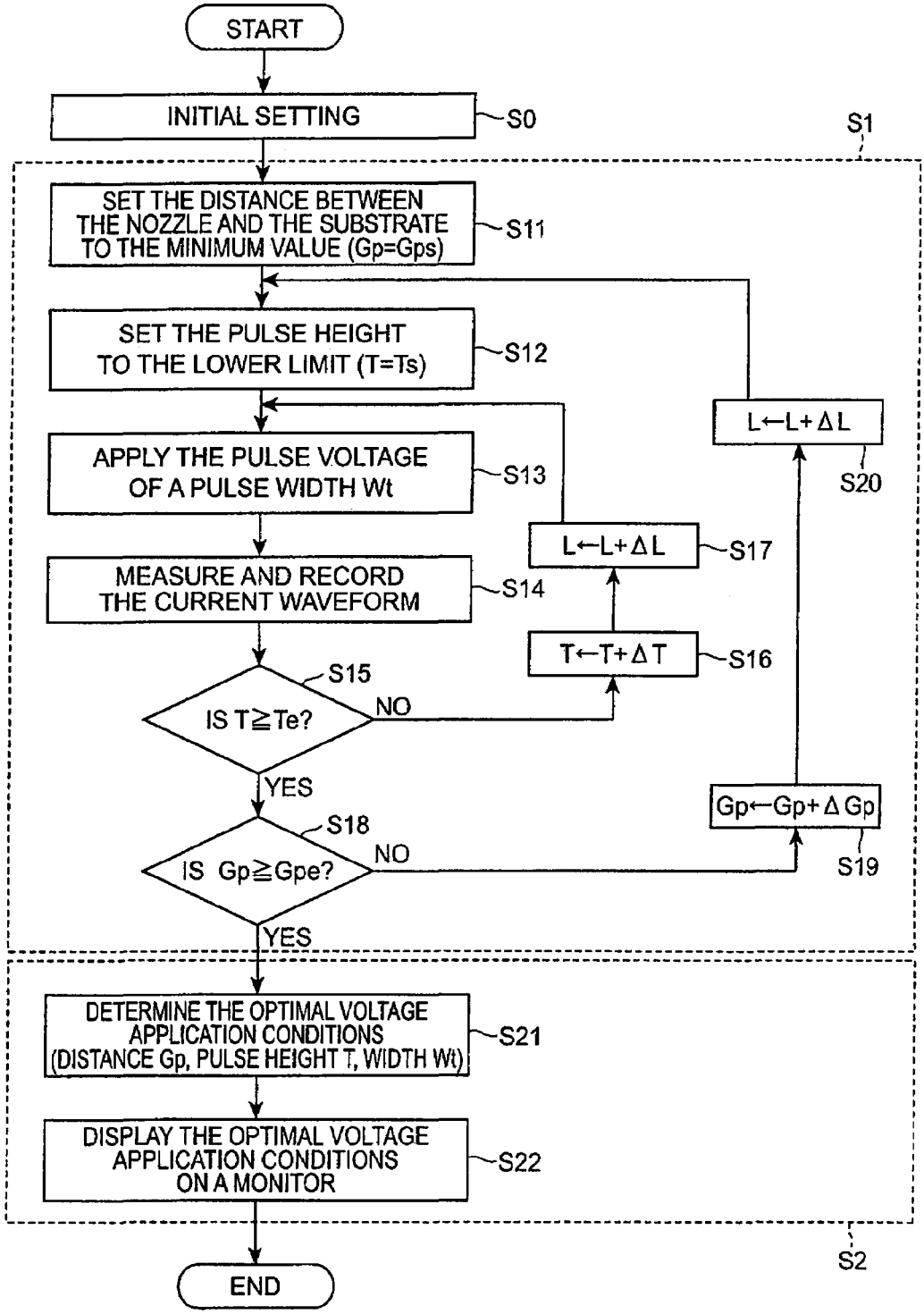
[FIG. 3] is a flowchart of a droplet forming condition determining method according to a first embodiment.

Operations of the droplet forming device, that is, a droplet forming method according to the present embodiment shall now be described with reference to FIGS. 1 and 3. FIG. 3 is a flowchart of the droplet forming method according to this embodiment. First, an upper limit Gpe and a step interval ΔGp of a distance Gp between the nozzle 3 and the substrate 5, an upper limit Te and a step interval ΔT of the pulse height T of the pulse voltage P of the pulse voltage generator 7, a time width Wt of the pulse voltage P, and other conditions are input, based on properties of the sample liquid 21 and a diameter of the nozzle 3, into the controller 13 (initial setting step, S0).

A waveform measuring step S1 is then performed. First, by controlling the XYZ stage 9, the distance Gp between the tip of the nozzle 3 and the substrate 5 is set to a minimum value Gps (S11). Also, the pulse height T of the pulse voltage P is set to a lower limit value Ts (S12). After thus setting the application voltage conditions of the pulse voltage P, the pulse voltage P of the pulse time width Wt is applied between the sample liquid 21 and the substrate 5 (S13).

By application of the pulse voltage P, the sample liquid 21 at the tip of the nozzle 3 is drawn toward the substrate 5, and a conical Taylor cone 23, constituted of the sample liquid 21, is formed on the tip of the nozzle 3. Then by the pulse voltage P, a jet stream 25, reaching from an apex of the Taylor cone 23 to the surface of the substrate 5, is formed, and a portion of the sample liquid 21 moves onto the substrate 5 and becomes the droplet 27. Here, although because the sample liquid 21 inside the nozzle 3 and the substrate 5 become equipotential for an instant, the apex of the Taylor cone 23 moves away from the substrate 5, by the accumulation of charges in the sample liquid 21, the apex of the Taylor cone 23 approaches the substrate 5 and the jet stream 25 is formed again. By the repetition of such phenomena, the sample liquid 21 is discharged from the tip of the nozzle 3 and the droplet 27 of the sample liquid 21 is formed on the substrate 5. Each time the jet stream 25 is formed, the pulse-form current I flows between the sample liquid 21 and the substrate 5. The current I is converted to a voltage by the resistor R and is measured and recorded as a temporal waveform by the oscilloscope 15 (S14). A plurality of pulse waveforms, corresponding to the formation of the jet stream 25, are contained in the temporal waveform of the current I.

The pulse height T of the pulse voltage P is then increased at increments of ΔT until the pulse height T becomes Te (>Ts) (S15, S16), and the application of the pulse voltage P (S13) and the measurement and recording of the temporal waveform of the current I by the oscilloscope 15 (S14) are repeated. Here, to prevent a droplet 27 formed in a previous step from influencing the measurement, the XYZ stage 9 is moved in a horizontal direction (X direction or Y direction) each time the pulse height T is increased and a droplet forming position L on the substrate 5 is moved by just ΔL (S17).

When the pulse height T of the pulse voltage P reaches the upper limit Te, the distance Gp between the tip of the nozzle 3 and the substrate 5 is increased by just ΔGp (S19), the droplet forming position L on the substrate 5 is moved by just ΔL (S20), and repetition of the measurement and recording of the temporal waveform of the current I by the oscilloscope 15 while increasing the pulse height T of the pulse voltage P from the lower limit Te to the upper limit Te by ΔT at a time is performed again (S12 to S17). This operation is repeated until the distance Gp between the tip of the nozzle 3 and the substrate 5 reaches the upper limit Gpe (S18). Temporal waveform data for the current I at each combination of the pulse height T, set at increments of ΔT from the lower limit Ts to the upper limit Te, and the distance Gp, set at increments of ΔGp from the lower limit Gps to the upper limit Gpe, are thus obtained. The waveform measuring step S1 in the present embodiment is thereby completed.

In the respective steps in the waveform measuring step S1, the XYZ stage 9 is controlled (S17 and S20) by the stage controller 11 according to an instruction signal A1 from the controller 13. The setting of the pulse height T of the pulse voltage P (S12 and S16) and the application of the pulse voltage (S13) are performed by the pulse voltage generator 7 according to an instruction signal A2 from the controller 13. The measurement and recording of the temporal waveform of the current I (S14) are performed by the oscilloscope 15 according to an instruction signal A3 from the controller 13. All of the respective steps S11 to S20 in the waveform measuring step S1 can thus be performed automatically according to instructions from the controller 13.

Figure 4:
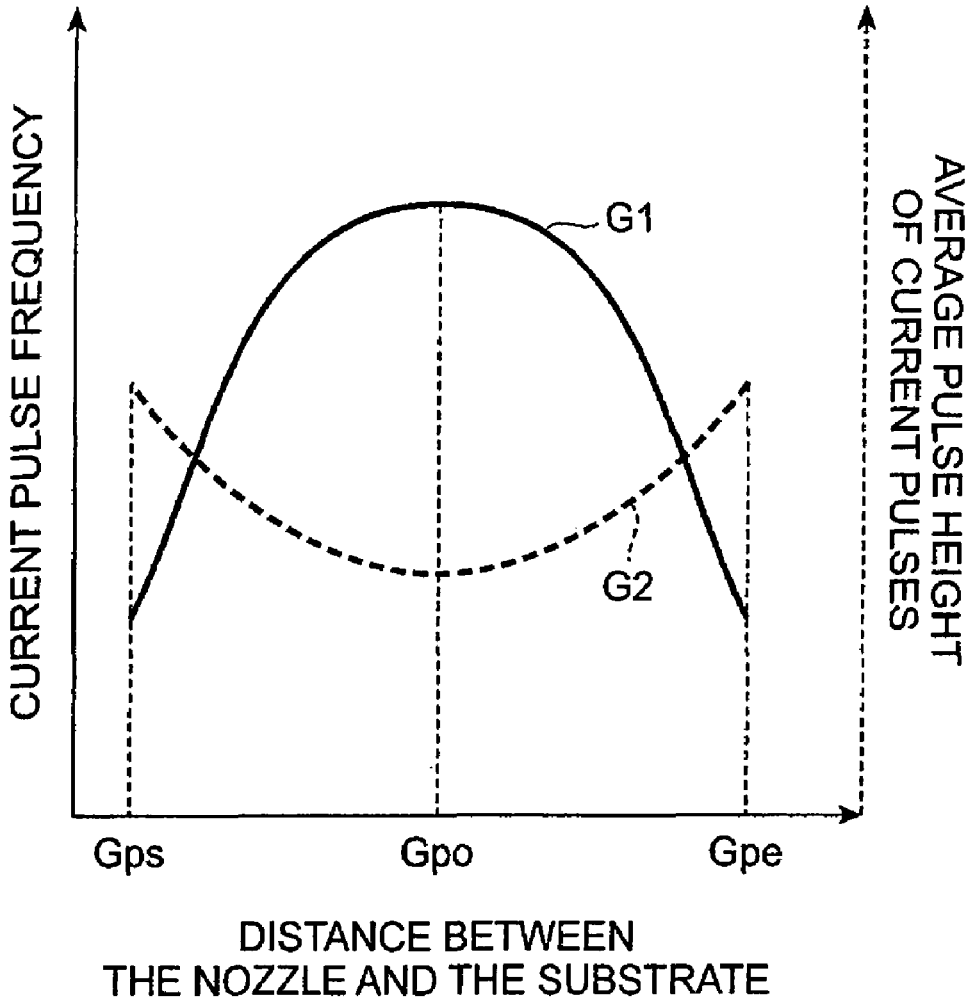
[FIG. 4] is a graph of an example of how an occurrence frequency and an average pulse height of current pulse waveforms vary when a distance Gp between a nozzle and a substrate, is varied from Gps to Gpe.

Optimal application conditions of the pulse voltage P in a process of forming a droplet on the substrate 5 are then determined based on the temporal waveform of the current I that was measured in the waveform measuring step S1 (application condition determining step, S2). During droplet formation under the satisfactory voltage application conditions, because the shape of the Taylor cone 23 that is drawn out from the tip of the nozzle 3 is comparatively stable, the pulse waveforms of the current I, flowing between the sample liquid 21 inside the nozzle 3 and the substrate 5, tend to occur in small intervals (that is, the number of times of occurrence per unit time (occurrence frequency) of the pulse waveforms tends to be high) and the average pulse height of the pulse waveforms tends to be small. FIG. 4 is a graph of an example of how the occurrence frequency and the average pulse height of the current pulse waveforms vary when the distance Gp, between the nozzle 3 and the substrate 5, is varied from Gps to Gpe. In FIG. 4, the abscissa indicates the distance Gp, the occurrence frequency of the current pulse waveforms is indicated by a solid line G1, and the pulse height of the current pulse waveforms is indicated by a broken line G2. If, in the above-described waveform measuring step S1, the occurrence frequency of the current pulse waveforms takes on a maximum value at a distance Gpo as indicated by the solid line G1 in FIG. 4 and the average pulse height of the current pulse waveforms takes on a minimum value at the distance Gpo as indicated by the broken line G2, the distance Gpo is the optimal distance Gp at which the shape of the Taylor cone 23 is most stable during droplet formation of the sample liquid 21.

Figure 5:
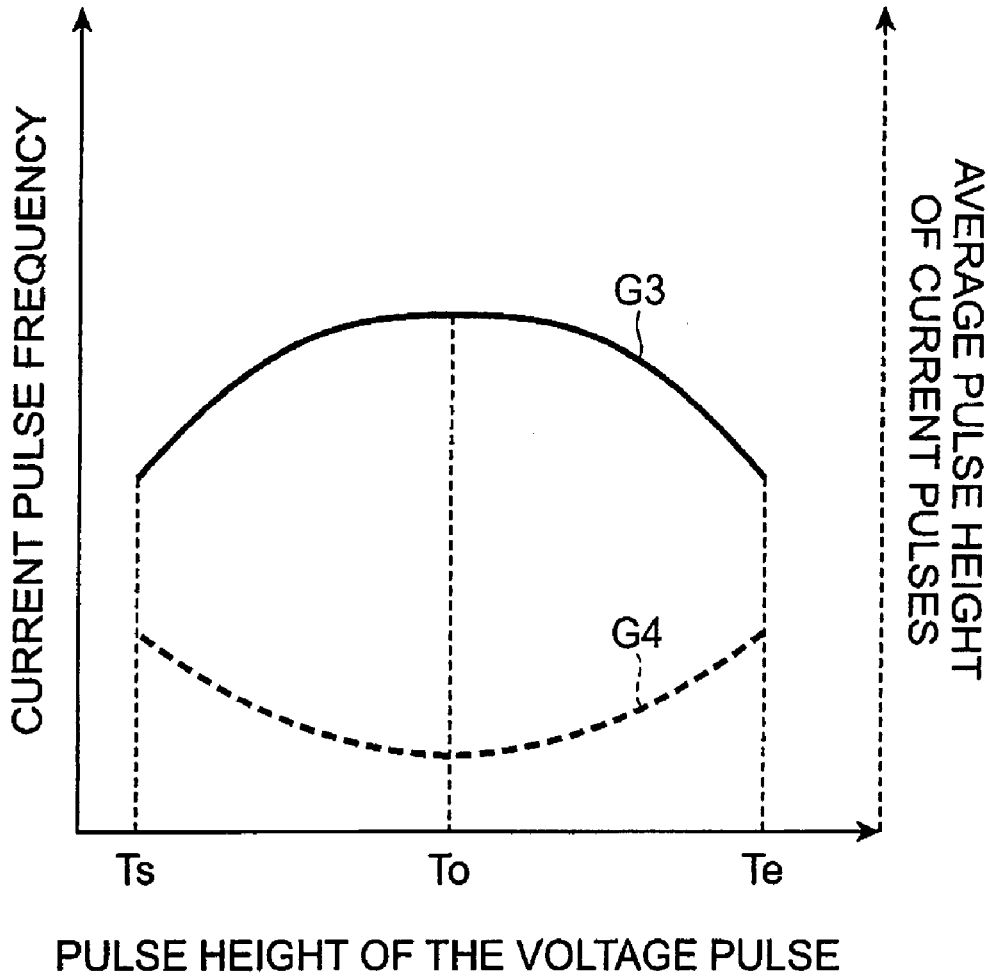
[FIG. 5] is a graph of an example of how the occurrence frequency and the average pulse height of current pulse waveforms vary when a pulse height T of a pulse voltage is varied from Ts to Te.

FIG. 5 is a graph of an example of how the occurrence frequency and the average pulse height of the current pulse waveforms vary when the pulse height T of the pulse voltage P is varied from Ts to Te. In FIG. 5, the abscissa indicates the pulse height T, the occurrence frequency of the current pulse waveforms is indicated by a solid line G3, and the pulse height of the current pulse waveforms is indicated by a broken line G4. If, in the above-described waveform measuring step S1, the occurrence frequency of the current pulse waveforms, as indicated by the solid line G3, takes on a maximum value at a pulse height To as shown in FIG. 5 and the average pulse height of the current pulse waveforms, as indicated by the broken line G4, takes on a minimum value at the pulse height To, the pulse height To is the optimal pulse height T at which the shape of the Taylor cone 23 is most stable during droplet formation of the sample liquid 21.

Figure 6:
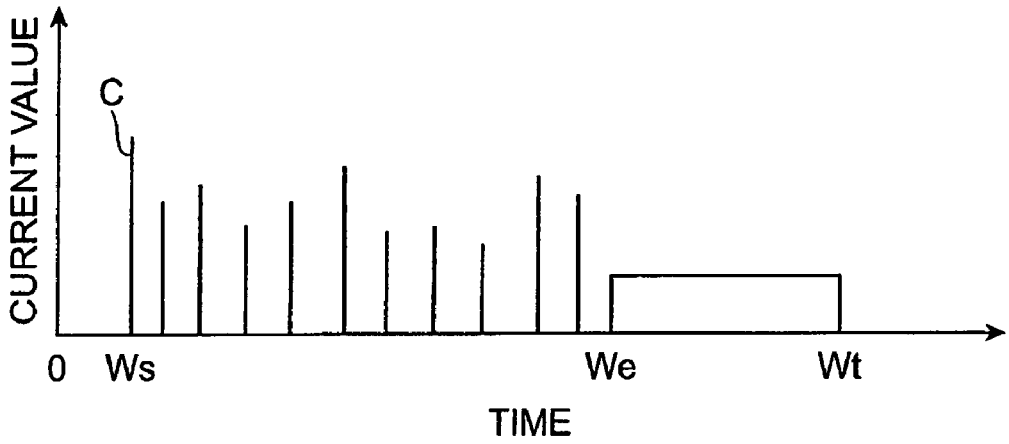
[FIG. 6] is a schematic view of a temporal waveform of a current that flows between a sample liquid, inside the nozzle, and the substrate.

FIG. 6 is a schematic view of the temporal waveform of the current I that flows between the sample liquid 21, inside the nozzle 3, and the substrate 5. The abscissa of FIG. 6 indicates the time elapsed from the start of application of the pulse voltage P and the ordinate indicates the current value of the current I. As shown in FIG. 6, a first current pulse waveform C appears at a point that is delayed by just a time Ws from the start of application of the pulse voltage P. This signifies that the time Ws is required from the start of application of the pulse voltage P to the formation of the Taylor cone 23 and the formation of the first jet stream 25. From this it can be understood that the time width Wt of the pulse voltage P must be set longer than the time Ws. Also, when a time We elapses from the start of application of the pulse voltage P, the current pulse waveform disappears and a constant current flows between the sample liquid 21 inside the nozzle 3 and the substrate 5. This indicates that after the elapse of the time We, the droplet 27 deposits excessively on the substrate 5 and becomes joined to the Taylor cone 23 so that the sample liquid 21 inside the nozzle 3 and the substrate 5 are put in a conducting state. From this it can be understood that the time width Wt of the pulse voltage P must be set shorter than the time We. The favorable time width Wt of the pulse voltage P is thus set within a range of Ws<Wt<We based on the temporal waveform of the current I.

By the method described above, the optimal voltage application conditions (the distance Gp between the nozzle 3 tip and the substrate 5, the pulse height T of the pulse voltage P, and the time width Wt of the pulse voltage P) for the sample liquid 21 are determined (S21). This step S21 is started by the waveform analyzer 17 receiving an analysis instruction signal A4 from the controller 13. That is, when the waveform analyzer 17 sends a data request signal A5 to the oscilloscope 15, temporal waveform data D1, concerning the temporal waveform of the current I, are supplied from the oscilloscope 15 according to the data request signal A5. Based on the temporal waveform data D1, the waveform analyzer 17 determines the occurrence frequencies and the average pulse height of the current pulse waveforms at the respective voltage application conditions (Gps<Gp<Gpe and Ts<T<Te) and determines the optimal voltage application conditions.

The optimal voltage application conditions determined in step S21 are transmitted as condition data D2 from the analyzer 17 to the controller 13. The controller 13 transmits the condition data D2 to the monitor 19, and the monitor 19 displays the optimal voltage application conditions (the distance Gp, the pulse height T, and the time width Wt) based on the condition data D2 (S22). An operator recognizes the optimal voltage application conditions by means of the display contents and, by setting the droplet forming device 1 to these conditions in the droplet forming step, can carry out the droplet forming step with stability on sample liquids with the same properties as the sample liquid 21.

Although the distance Gp between the nozzle 3 and the substrate 5 and the pulse height T of the pulse voltage P were optimized individually in the present embodiment in order to facilitate understanding, the optimal distance Gp and pulse height T are more preferably determined in a three-dimensional plot, in which the occurrence frequency and the average pulse height of the current pulse waveforms are respectively plotted with the distance Gp and the pulse height T as variables. The time width Wt of the pulse voltage P is then determined by the above-described method.

Although with the present embodiment, temporal waveforms of the current I are acquired for all combinations of the distance Gp and the pulse height T in the predetermined ranges, temporal waveforms of the current I may first be acquired while varying just one of the distance Gp or the pulse height T, and after determining the optimal value Gpo or To of the distance Gp or the pulse height T, temporal waveforms of the current I may be acquired while varying the other of the distance Gp or the pulse height T to determine the optimal value thereof as in an embodiment to be described below. Although the precision of optimization is lowered with this method, the optimal application conditions can be determined more simply.

Effects of the droplet forming condition determining method according to the embodiment described above shall now be described. The behavior (for example, the shape of the Taylor cone 23) of the sample liquid 21 during the forming of the droplet 27 on the substrate 5 varies according to the application conditions of the pulse voltage P. If the shape of the Taylor cone 23 is unstable, the jet stream 25, formed from the apex of the Taylor cone 23, is not stable and a satisfactory droplet 27 cannot be formed.

As a result of diligent research, the present inventors found that the behavior of the sample liquid 21 during formation of the droplet 27 on the substrate 5 can be observed by means of the temporal waveform of the current I that flows between the sample liquid 21 and the substrate 5. That is, during droplet formation under satisfactory voltage application conditions, the occurrence frequency of the pulse waveforms tends to be high and the average pulse height of the pulse waveforms tends to be small because the shape of the Taylor cone 23 is comparatively stable. With the droplet forming condition determination method according to the present invention, because in the application condition determining step S2, the application conditions of the pulse voltage P are determined based on temporal waveforms of the current I that flow between the sample liquid 21 and the substrate 5, the application conditions of the pulse voltage P applied between the sample liquid 21 and the substrate 5 can be optimized readily even with a sample liquid 21, such as 3×SSC, that has a comparatively high conductivity.

Also preferably in the application condition determining step S2, at least one condition among the distance Gp between the tip of the nozzle 3 and the substrate 5, the pulse height T of the pulse voltage P, and the time width Wt of the pulse voltage P is determined as the application condition of the pulse voltage P as in the present embodiment. The behavior of the sample liquid 21, such as the shape of the Taylor cone 23, during the forming of the droplet 27 on the substrate 5 can thereby be controlled favorably and the amount of the droplet 27 in each dispensation can be stabilized readily. Also, although the distance Gp, the pulse height T, and the time width Wt are cited as application conditions of the pulse voltage P in the present embodiment, the application conditions of the pulse voltage P are not restricted thereto. For example, the droplet forming condition determining step in the present embodiment may be applied to determine conditions for determining the shape of the pulse voltage (which is not restricted to being rectangular) and conditions for determining the ambient temperature and other environmental conditions.

Also preferably in the application condition determining step S2, the application conditions of the pulse voltage P are determined based on the occurrence frequency of the plurality of current pulse waveforms contained in the temporal waveform of the current I as in the present embodiment. As mentioned above, the present inventors found, as a result of research, that during the forming of the droplet 27, a plurality of current pulse waveforms, each due to the jet stream 25, are contained in the temporal waveform of the current I that flows between the sample liquid 21 and the substrate 5. Furthermore, it was found that the higher the occurrence frequency of the current pulse waveforms, the more stable the shape of the Taylor cone 23 and the more stable the amount of the droplet 27 in each dispensation. With the droplet forming condition determining step of the present embodiment, by determining the application conditions of the pulse voltage P based on the occurrence frequency of the current pulse waveforms, the behavior of the sample liquid 21, such as the shape of the Taylor cone 23, during the forming of the droplet 27 on the substrate 5 can be controlled favorably and the amount of the droplet 27 can be stabilized readily in each dispensation.

Also preferably in the application condition determining step S2, the application conditions of the pulse voltage P are determined based on the pulse height of the current pulse waveforms contained in the temporal waveform of the current I as in the present embodiment. As mentioned above, the present inventors found, as a result of research, that during the forming of the droplet 27, the lower the pulse height of the current pulse waveforms (that is, the smaller the current values in the current pulse waveforms), the more stable the shape of the Taylor cone 23 and the more stable the amount of the droplet 27 in each dispensation. With the droplet forming condition determining step of the present embodiment, by determining the application conditions of the pulse voltage P based on the pulse height of the current pulse waveforms, the behavior of the sample liquid 21, such as the shape of the Taylor cone 23, during the forming of the droplet 27 on the substrate 5 can be controlled favorably and the amount of the droplet 27 can be stabilized readily in each dispensation. As the pulse height of the current pulse waveforms, the average value of the respective pulse heights of the plurality of current pulse waveforms is preferably used as in the present embodiment.

Also, the droplet forming device 1 according to the present embodiment provides the following effects. That is, the droplet forming device 1 according to this embodiment, by being equipped with the nozzle 3 that retains the sample liquid 21, the XYZ stage 9, on which the substrate 5 is placed so as to oppose the tip of the nozzle 3, the pulse voltage generator 7 that applies the pulse voltage P between the sample liquid 21 and the substrate 5, and the resistor R and the oscilloscope 15 for measuring the temporal waveform of the current I that flows between the sample liquid 21 and the substrate 5 according to the pulse voltage P, can perform the waveform measuring step S1 and the application condition determining step S2 favorably to determine the droplet forming conditions.

Preferably, the droplet forming device 1 has a moving means (the XYZ stage 9) that varies relative positions of the tip of the nozzle 3 and the substrate 5 as in the present embodiment. The task for determining the distance Gp between the tip of the nozzle 3 and the substrate 5 (specifically, the task of moving the substrate 5 in the steps S17, S19, and S20), among the application conditions of the pulse voltage P, can thereby be performed simply.

Also preferably, the droplet forming device 1 has the waveform analyzer 17 as an analyzing means for analyzing the temporal waveform of the current I measured by the oscilloscope 15, and the waveform analyzer 17 determines the occurrence frequency of the plurality of current pulse waveforms contained in the temporal waveform of the current I as in the present embodiment. The task of determining the application conditions of the pulse voltage P based on the occurrence frequency of the plurality of current pulse waveforms contained in the temporal waveform of the current I (step S21) is thereby facilitated. Also preferably, the waveform analyzer 17 determines the pulse height of the current pulse waveforms contained in the temporal waveform of the current I. The task of determining the application conditions of the pulse voltage P based on the pulse height of the current pulse waveforms contained in the temporal waveform of the current I (step S21) is thereby facilitated.

Also preferably, the droplet forming device 1 has the waveform analyzer 17 as an application voltage determining means that determines, on the basis of the temporal waveform of the current I, the application conditions of the pulse voltage P during the forming of the droplet 27 on the substrate 5 as in the present embodiment. The task of determining the application conditions of the pulse voltage P (step S21) is thereby simplified. Although in the present embodiment, the waveform analyzer 17 serves in common as the analyzing means and the application condition determining means, these means may be realized by mutually different devices.

A specific example (Example 1) of the above-described method for determining the droplet forming conditions shall now be described. In this Example, the SSC buffer solution was used at the concentration of 3×SSC as the sample liquid 21. As described above, the 3×SSC buffer has an extremely high conductivity in comparison to pure water. It was confirmed that the effects of the above-described method for determining droplet forming conditions are adequately exhibited even with a liquid with such a high conductivity.

In the present example, a glass capillary nozzle with an inner diameter of 12 μm was used as the nozzle 3. As the substrate 5, a glass substrate (referred to hereinafter as the "ITO substrate"), coated with an indium-tin oxide (ITO) thin film, was used. This ITO substrate was fixed onto a precision Z stage so that the distance Gp between the glass capillary nozzle and the ITO substrate can be controlled at high precision. Arrangements were also made to enable the forming of the droplet 27 at an arbitrary position on the ITO substrate by control of the horizontal position of the ITO substrate by an XY motorized stage. The precision. Z stage and the XY motorized stage in this Example correspond to being the XYZ stage 9 in the above-described embodiment.

A tungsten electrode was inserted into the inner side of the glass capillary nozzle, and by connecting the positive terminal of the pulse voltage generator 7 to the tungsten electrode and the negative terminal to the ITO substrate, application of the pulse voltage P between the 3×SSC solution inside the nozzle and the ITO substrate was enabled. Arrangements were also made to convert the current I, flowing between the 3×SSC solution inside the nozzle and the ITO substrate, to a potential difference between respective ends of the resistor R (10MΩ), which was measured by the oscilloscope 15 (digital oscilloscope) operating in synchronization with the application of the pulse voltage to record the temporal waveform of the current I as digital data.

Using the above arrangement, liquid drops 27 were formed while varying the various voltage application conditions of the distance GP between the glass capillary nozzle and the ITO substrate, the pulse height T of the pulse voltage P, and the time width Wt of the pulse voltage P, and the temporal waveforms of the current I during these processes were measured.

First, the range of the distance Gp was determined based on the inner diameter of the glass capillary nozzle. Here, it is preferable to determine the lower limit Gps of the distance Gp in reference to a case where the sample liquid 21 is water. In the case where the sample liquid 21 is water, an inclination angle of a side surface of the Taylor cone 23 formed by the electrostatic force is 49.3°. Because the nozzle inner diameter in this Example was set to 12 μm, when the sample liquid 21 is water, the height of the Taylor cone 23 (the length between a bottom surface and the apex) is 5.2 μm by calculation. Thus with the present Example, the lower limit Gps, the upper limit Gpe, and the increment ΔGp of the distance Gp were respectively set as: Gps=5 μm; Gpe=20 μm; and ΔGp=2.5 μm. The lower limit Ts, the upper limit Te, and the increment ΔT of the pulse height T of the pulse voltage P were respectively set as: Ts=200V; Te=3000V; and ΔT=200V; and the time width Wt of the pulse voltage P was set to 150 ms.

Figure 7:
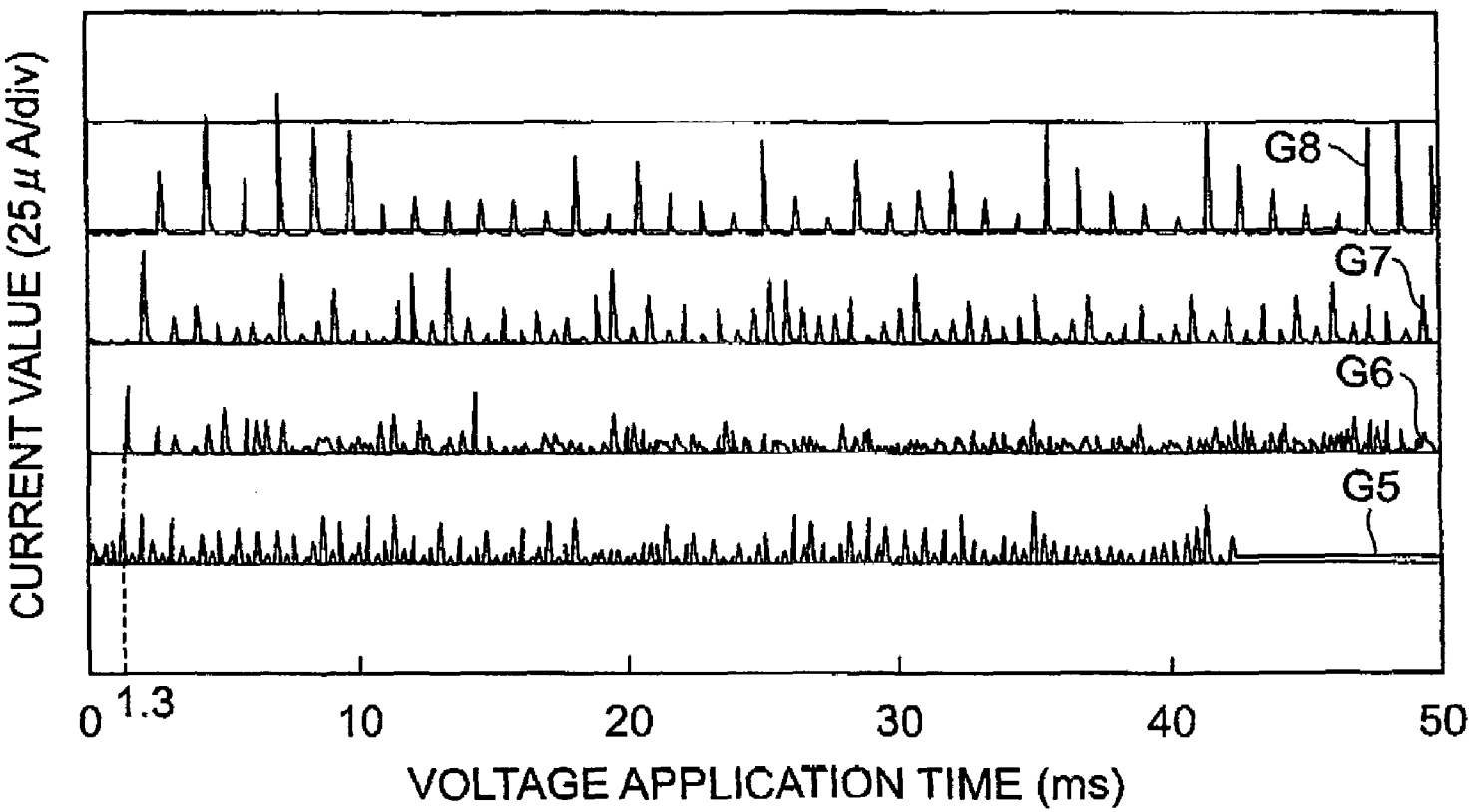
[FIG. 7] shows graphs of temporal waveforms of currents for cases where the distance Gp=5 μm (graph G5), 10 μm (graph G6), 15 μm (graph G7), and 20 μm (graph G8) with the pulse height T being 2000V.

FIG. 7 shows graphs of the temporal waveforms of the current I for cases where the distance Gp=5 μm (line G5), 10 μm (line G6), 15 μm (line G7), and 20 μm (line G8) with the pulse height T being 2000V. In FIG. 7, the abscissa indicates the elapsed time and the ordinate indicates the current value (25 mA per division). Although the pulse voltage P of the time width Wt=150 ms was applied in the present Example, temporal waveforms up to 50 ms are shown in FIG. 7 to enable the current pulse shapes to be observed readily.

As shown in FIG. 7, each temporal waveform of the current I takes on the form of intermittent pulses. In cases where the 3×SSC solution of high conductivity is used, when the jet stream 25 contacts a droplet 27 on the ITO substrate, the Taylor cone 23 and the surface of the droplet 27 are made equipotential instantaneously and the electrostatic force disappears. The jet stream 25 disappears accordingly and the Taylor cone 23 and the surface of the droplet 27 are put in an open interval state. Because the pulse voltage P is applied successively at this time, a potential difference arises again between the Taylor cone 23 and the surface of the droplet 27 and the jet stream 25 is formed. The temporal waveforms of FIG. 7 are considered to be due to this repetition of formation and disappearance of the jet stream 25.

With a stable Taylor cone 23, the temporal waveform of the current I is considered to meet the following two conditions. Firstly, it is considered that because the jet stream 25, jetting out from the apex of the Taylor cone 23, becomes minute, the conducting path formed by the jet stream 25 becomes high in resistance electrically and the pulse height of the current pulse waveform becomes low. As another point, it is considered that because the shape of the apex of the Taylor cone 23 from which the jet stream 25 jets out is stable, current pulse waveforms of short repetition cycle are formed. Thus by analyzing the occurrence frequency per unit time of the current pulse waveforms and the average pulse height of the current pulse waveforms from the temporal waveform of the current I acquired under the respective application voltage conditions, the optimal application voltage conditions can be found.

Figure 8:
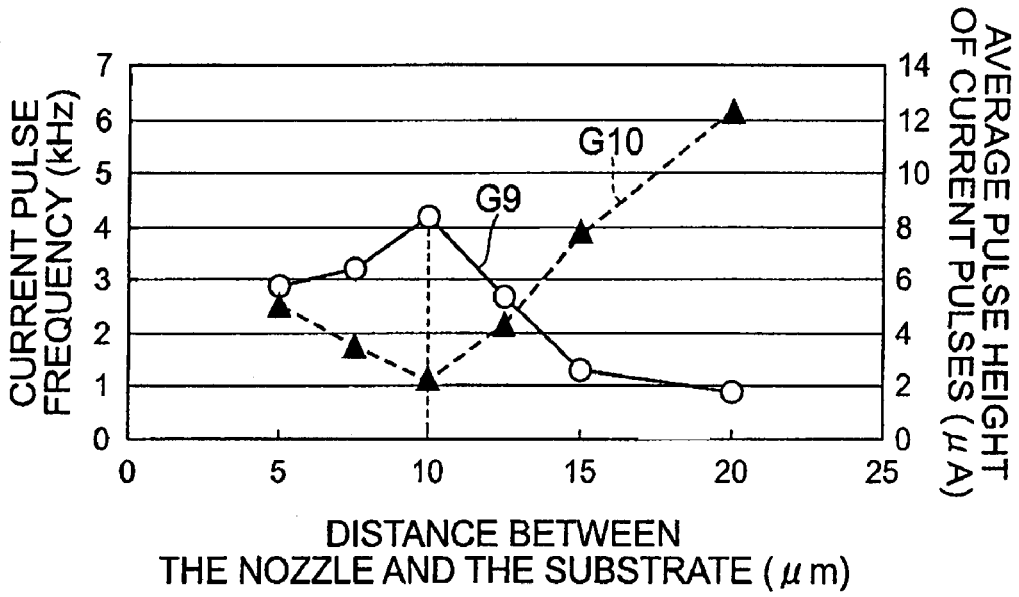
[FIG. 8] is a diagram of correlations between the distance GP and the occurrence frequency or the average pulse height of current pulse waveforms in an Example 1.

With the present Example, first, the distance Gp was varied at 2.5 μm increments from 5 μm to 20 μm and the frequency and the average pulse height of the current pulse waveforms for the pulse voltage P of pulse height T=2000V were determined for each distance. In FIG. 8, the abscissa indicates the distance Gp and the ordinate indicates the occurrence frequency and the average pulse height of the current pulse waveforms. In FIG. 8, the solid line G9 indicates the frequency of current pulse waveforms, and the broken line G10 indicates the average pulse height of the current pulse waveforms. Referring to FIG. 8, the occurrence frequency of the current pulse waveforms is maximized and the average pulse height is minimized when the distance Gp=10 μm, and this agrees most with the above-described stability conditions of the Taylor cone 23. The optimal value Gpo of the distance Gp in the present Example is thus 10 μm.

Figure 9:
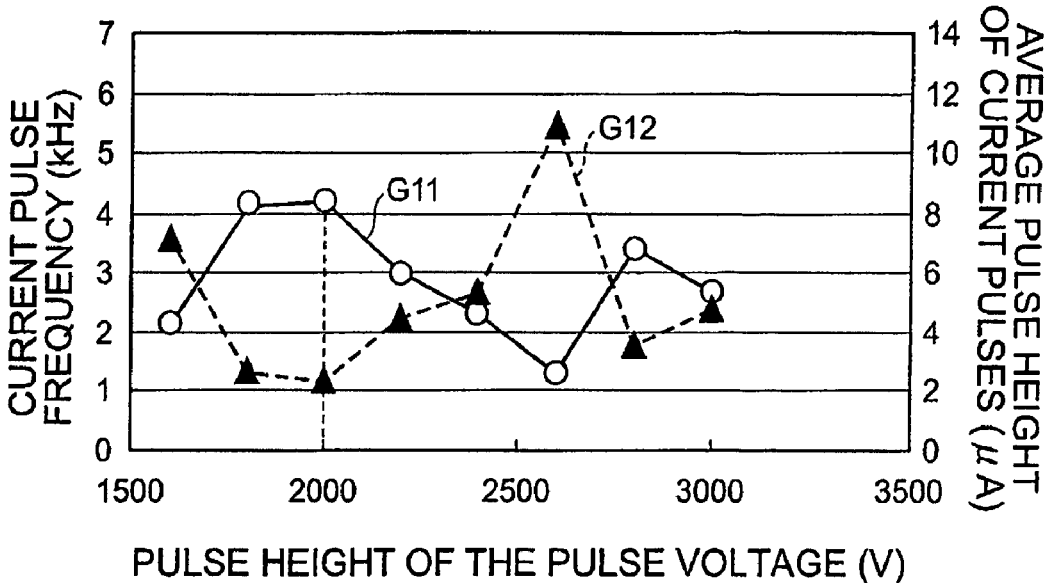
[FIG. 9] is a diagram of correlations between the pulse voltage pulse height T and the occurrence frequency or the average pulse height of the current pulse waveforms in the Example 1.

The occurrence frequency and the average pulse height of the current pulse waveforms were then measured at the distance Gp=10 μm (=optimal value Gpo), while varying the pulse height T of the pulse voltage P at 200V increments from 200V to 3000V. In FIG. 9, the abscissa indicates the pulse height T of the pulse voltage P and the ordinate indicates the occurrence frequency and the average pulse height of the current pulse waveforms. In FIG. 9, the solid line G11 indicates the occurrence frequency of current pulse waveforms, and the broken line G10 indicates the average pulse height of the current pulse waveforms. Referring to FIG. 9, the occurrence frequency of the current pulse waveforms is maximized and the average pulse height is minimized when the pulse height T of the pulse voltage P is 2000V, and this agrees most with the above-described stability conditions of the Taylor cone 23. The optimal value To of the pulse height T of the pulse voltage P in the present Example is thus 2000V.

Lastly, the preferable range of the time width Wt of the pulse voltage P was determined. Referring again to FIG. 7, it can be understood that when the distance Gp=10 μm and the pulse height T of the pulse voltage P is 2000V (line G6), the current pulse waveforms arise from 1.3 ms after application of the pulse voltage P and onwards. Also with these voltage application conditions, the droplet 27 did not deposit excessively and become connected with the Taylor cone 23 within the time width Wt of the pulse voltage P of 150 ms. It was thus confirmed that the time width Wt of the pulse voltage P can be set to an arbitrary value within a range of 1.3 ms<Wt<150 ms.

With the present example, based on the above results, it was possible to determine the distance Gp between the nozzle 3 and the substrate 5 of 10 μm, the pulse height T of the pulse voltage P of 2000V, and the time width Wt of the pulse voltage P within the range of 1.3 ms<Wt<150 ms as the favorable application voltage conditions for forming the droplet of 3×SSC, which is a highly conductive solution.

Another example (Example 2) of the above-described method for determining droplet forming conditions shall now be described. With this Example, a case of using a plurality of nozzles 3 to form a single droplet of the sample liquid 21, retained in each of the plurality of nozzles 3, on the substrate 5 shall be described. As the sample liquid 21, the same 3×SSC as that of the Example 1 was used. Also as the substrate 5, the same ITO substrate as that of the Example 1 was used.

First, two nozzles 3 (glass capillary nozzles) were prepared and each nozzle 3 was filled with the 3×SSC solution. As these nozzles 3, those with an outer diameter of 13 μm and an inner diameter of 7.8 μm were used. These nozzles 3 were aligned and positioned so that the mutual interval between the nozzles 3 was 17 μm. The pulse voltage P was then applied between each of the 3×SSC solutions in the respective nozzles 3 and the ITO substrate to form a droplet on the ITO substrate.

Figure 10:
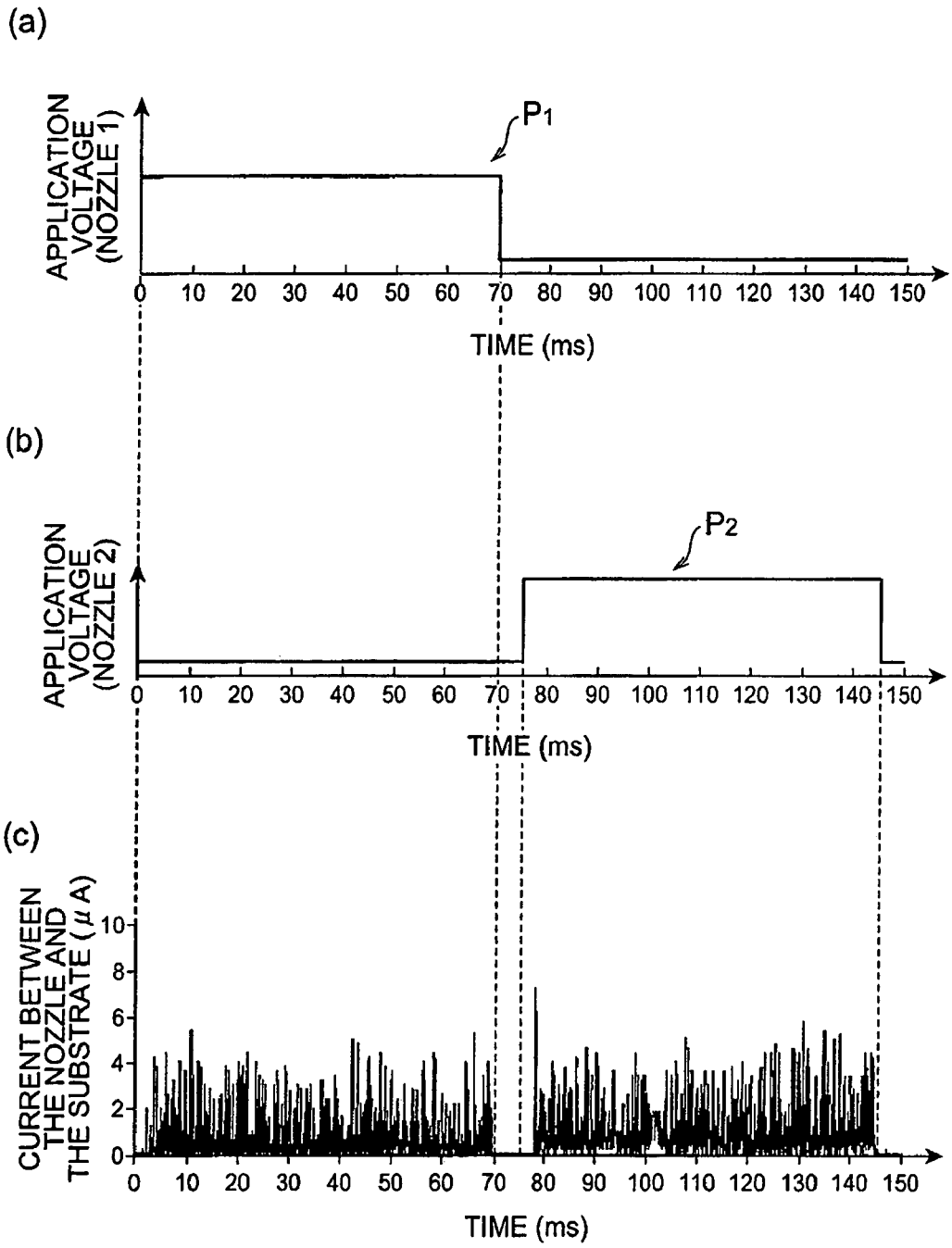
[FIG. 10] is (a) a graph of an example of a temporal waveform of a pulse voltage applied to a 3×SSC solution in one nozzle in an Example 2, (b) a graph of an example of a temporal waveform of a pulse voltage applied to a 3×SSC solution in another nozzle in the Example 2, and (c) a graph of a temporal waveform of the current flowing between the 3×SSC solution and an ITO substrate due to the pulse voltages shown in (a) and (b).

FIG. 10(*a*) is a graph of an example of the temporal waveform of a pulse voltage P1 applied to the 3×SSC solution in one of the nozzles 3 in this Example (pulse height T=1000V, time width Wt=70 ms), and FIG. 10(*b*) is a graph of an example of the temporal waveform of a pulse voltage P2 applied to the 3×SSC solution in the other nozzle 3 (pulse height T=1000V, time width Wt=70 ms). FIG. 10(*c*) is a graph of the temporal waveform of the current I that was made to flow between the 3×SSC solutions and the ITO substrate by the pulse voltages P1 and P2 shown in FIGS. 10A and 10B. FIG. 10(*c*) is the graph for the case where the distance Gp between tips of the respective nozzles 3 and the ITO substrate is 7.5 μm.

In this Example 2, first, as shown in FIG. 10(*a*), the pulse voltage P1 is applied between the 3×SSC solution inside the one nozzle 3 and the ITO substrate. The current I that flows between the 3×SSC solution and the ITO substrate is then measured (FIG. 10(*c*)) to obtain a current pulse waveform set A. The distance Gp between the one nozzle 3 and the ITO substrate, the pulse height T of the pulse voltage P1, and the time width Wt of the pulse voltage P1 are then determined by the method of the above-described embodiment so that the average pulse height of the current pulse waveform set A is minimized and the frequency of the individual pulse waveforms in the current pulse waveform set A is maximized.

Then after setting a certain time interval (5 ms in the present Example) from the end of application of the pulse voltage P1, the pulse voltage P2 is applied between the 3×SSC solution inside the other nozzle 3 and the ITO substrate as shown in FIG. 10(*b*). The current I that flows between the 3×SSC solution and the ITO substrate is then measured (FIG. 10(*c*)) to obtain a current pulse waveform set B. The distance Gp between the other nozzle 3 and the ITO substrate, the pulse height T of the pulse voltage P2, and the time width Wt of the pulse voltage P2 are then determined by the method of the above-described embodiment so that the average pulse height of the current pulse waveform set B is minimized and the frequency of the individual pulse waveforms in the current pulse waveform set B is maximized.

As described above, when a plurality of nozzles 3 are used, first a droplet is formed using one nozzle 3 and thereafter a droplet is formed using the other nozzle 3. In this case, to determine the pulse voltage application conditions, first, the application conditions of the pulse voltage P1 for the one nozzle 3 are determined and thereafter, the application conditions of the pulse voltage P2 for the other nozzle 3 are determined. The droplet forming condition determining step in the droplet forming method according to the present invention can thus be applied to cases of forming droplets using a plurality of nozzles.

Second Embodiment

A second embodiment of the droplet forming method according to the present invention shall now be described. With this embodiment, after determining the application conditions of the pulse voltage P using the method according to the first embodiment, the temporal waveform of the current I that flows between the sample liquid 21 and the substrate 5 during dispensing of the sample liquid 21 under these application conditions is integrated to measure the volume of the dispensed droplet 27.

Figure 11:
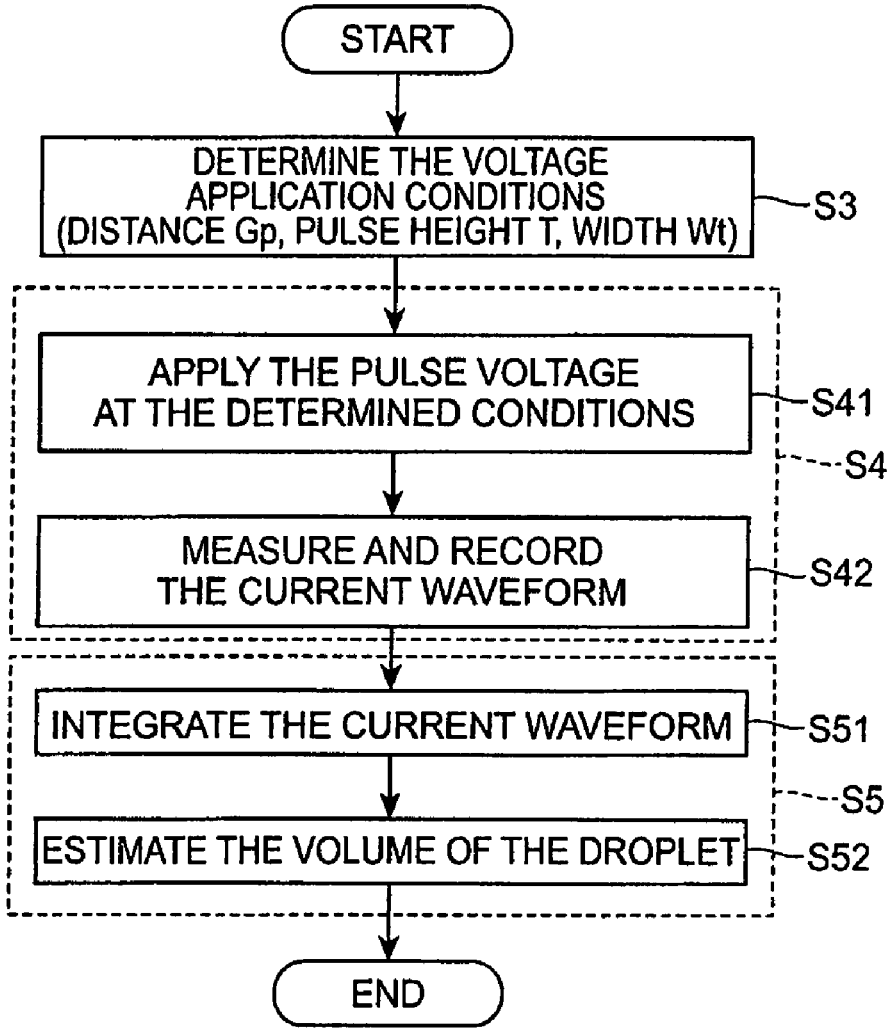
[FIG. 11] is a flowchart of a droplet volume measuring method according to a second embodiment.

FIG. 11 is a flowchart of the droplet volume measuring method according to this embodiment. First, by the droplet forming condition determining method in the first embodiment, the distance Gp between the tip of the nozzle 3 and the substrate 5, the pulse height T of the pulse voltage P, and the time width Wt of the pulse voltage P are determined (droplet forming condition determining step S3). A waveform measuring step S4 is then performed. In this waveform measuring step S4, first, the respective voltage application conditions (the distance Gp, the pulse height T, and the time width Wt), determined in the droplet forming condition determining step S3, are set in the droplet forming device 1, and by then applying the pulse voltage P between the sample liquid 21 inside the nozzle 3 and the substrate 5, the sample liquid 21 is dispensed onto the substrate 5 and the droplet 27, constituted of the sample liquid 21, is formed (S41). During the dispensation of the sample liquid 21 onto the substrate 5, the temporal waveform of the current I that flows between the sample liquid 21 and the substrate 5 is measured. Specifically, the potential difference arising between respective ends of the resistor element R due to the current I is measured and recorded by the oscilloscope 15 (S42).

The temporal waveform of the current I that was measured and recorded in the waveform measuring step S4 is then integrated to measure the volume of the droplet 27 (volume measuring step S5). In the volume measuring step S5, first, the temporal waveform, which, within the temporal waveform of the current I obtained in step S42, is of an interval corresponding to the time width Wt of the pulse voltage P, is integrated (S51). Then based on the integration value obtained, the measured value of the volume of the droplet 27 is determined, for example, by multiplying the integration value by a predetermined constant (S52).

As mentioned above in regard to the first embodiment, the current I that flows between the sample liquid 21 inside the nozzle 3 and the substrate 5 arises as a result of the movement of the sample liquid 21 inside the nozzle 3 onto the substrate 5. Specifically, the jet stream 25 is formed between the apex of the Taylor cone 23 of the sample liquid 21 and the substrate 5 by the application of the pulse voltage P, and the current I arises as a result of charges passing through the jet stream 25. The total amount of the charges that pass through in this process is correlated with the total time during which the jet stream 25 is formed, and the total amount of the sample liquid 21 that moved onto the substrate 5 as a result of the jet stream 25 (that is, the volume of the droplet 27) is also related to the total time during which the jet stream 25 is formed. Thus with the step of measuring the volume of the droplet 27 according to the present embodiment, by integrating the temporal waveform of the current I (that is, by determining the total amount of charges that have passed between the sample liquid 21 inside the nozzle 3 and the substrate 5), the volume of the droplet 27 can be measured readily and with good precision.

A specific example (Example 3) of this volume measuring method shall now be described. In this Example 3, the same 3×SSC as that used in the Example 1 was used as the sample liquid 21. As the substrate 5, a substrate (referred to hereinafter as a "PVA-coated ITO substrate"), with which a PVA (polyvinyl alcohol) film was coated onto the surface of a glass substrate having ITO vapor-deposited thereon, was used. A nozzle with an outer diameter of 20 μm and an inner diameter of 12 μm was used as the nozzle 3.

First, the application conditions of the pulse voltage P were determined by the droplet forming condition determining step in the above-described first embodiment. The optimal application conditions in the Example 3 were a distance Gpo between the nozzle 3 and the PVA-coated ITO substrate of 10 μm, a pulse height To of the pulse voltage P of 1500V, and a time width Wt of the pulse voltage P of 120 ms.

Figure 12:
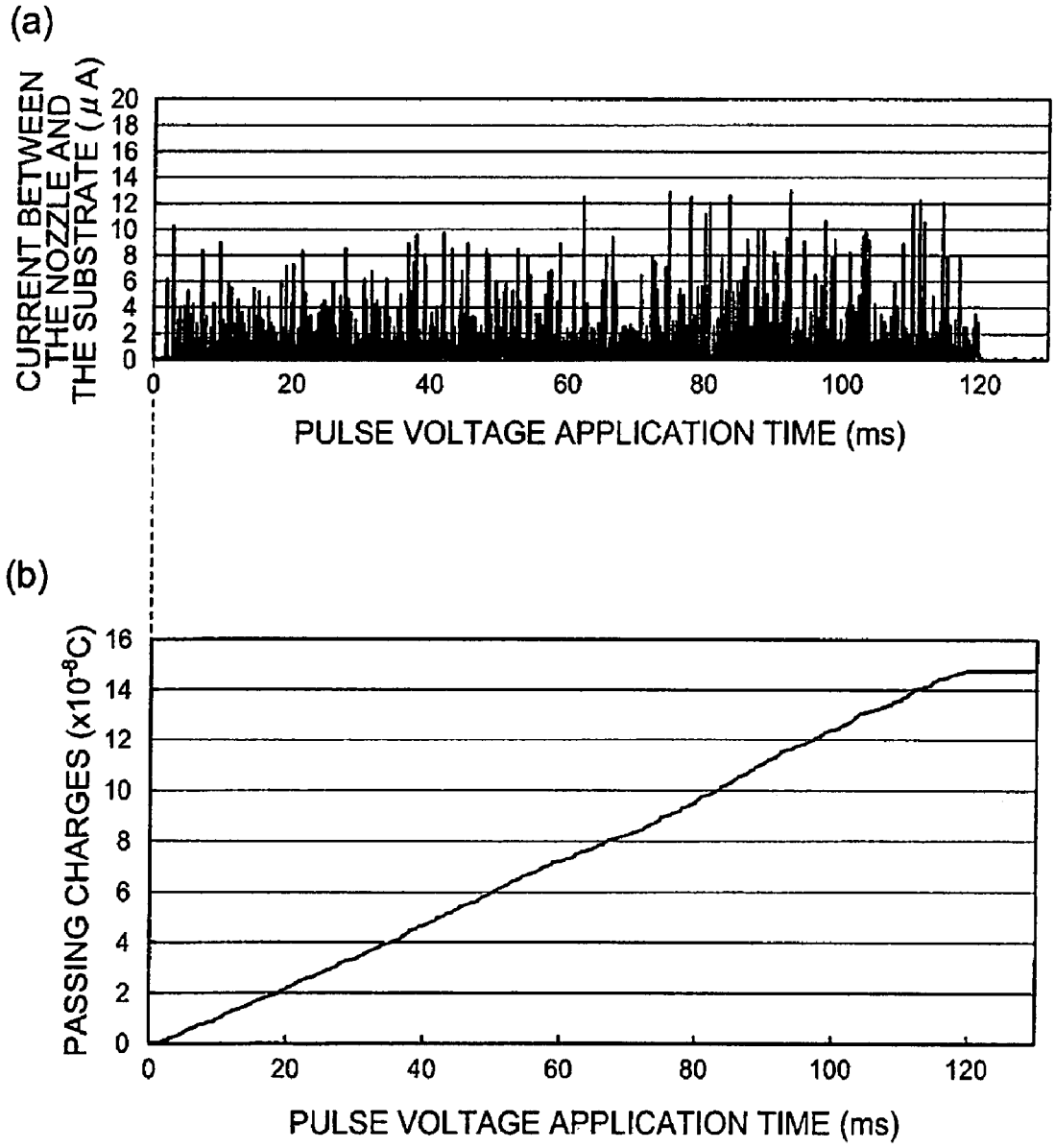
[FIG. 12] is (a) a graph of a temporal waveform of a current in an Example 3, and (b) a graph of correlation between an integration value of the temporal waveform of the current shown in (a) and a time elapsed from the start of application of a pulse voltage.

The droplet forming device 1 was then set to the determined application conditions, the droplet 27 was formed by dispensing the 3×SSC onto the PVA-coated ITO substrate, and the temporal waveform of the current I, flowing between the 3×SSC inside the nozzle 3 and the PVA-coated ITO substrate, was measured and recorded. The integration value of this temporal waveform of the current I was then determined. FIG. 12(*a*) is a graph of the temporal waveform of the current I in the present Example. FIG. 12(*b*) is a graph of correlation between the integration value of the temporal waveform of the current I shown in FIG. 12(*a*) and the time elapsed from the start of application of the pulse voltage P. Referring to FIG. 12(*b*), the integration value of the temporal waveform of the current I was a value that was substantially proportional to the time elapsed from the start of application of the pulse voltage P.

Figure 13:
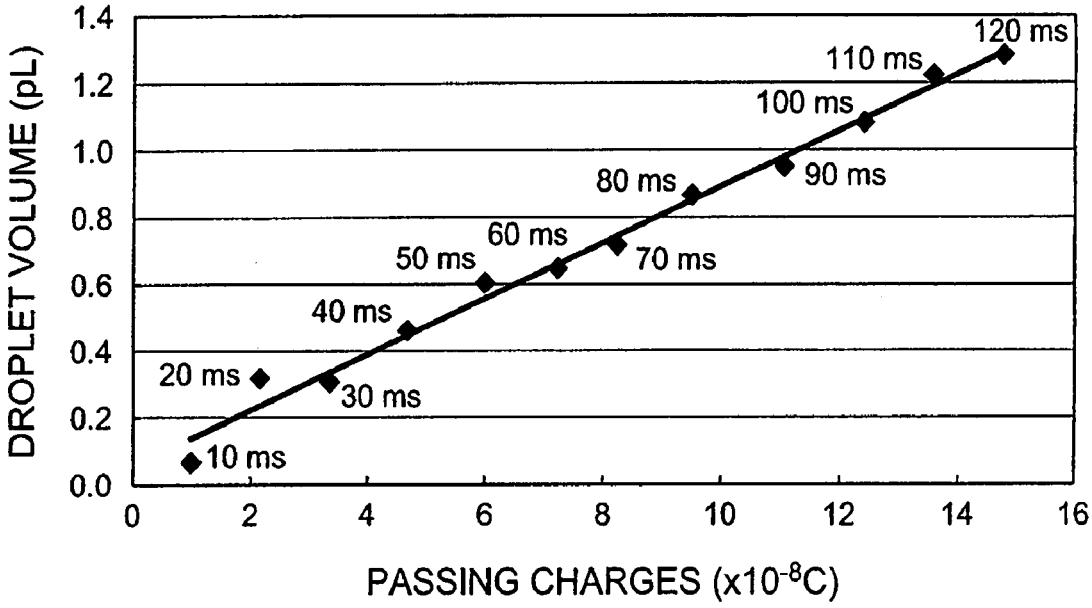
[FIG. 13] is a graph of a relationship between an amount of charges passing through and a volume of a droplet.

Next, the relationship between the volume of the droplet 27 and the integration value of the current I (the amount of charges passing through) was studied. The volume V of the droplet 27 was determined by observing the profile (section viewed from a side) of the droplet 27 bulging from the surface of the PVA-coated ITO substrate by means of a long working distance objective lens (made by Mitutoyo Corp.) to measure the height h of the droplet 27 and the radius r of the bottom surface of the droplet 27, and using a volume conversion formula ($V=\pi(h3/6+h\cdot r2/2)$). The shape of the droplet at each elapsed time was observed using a high-speed camera (FASTCAM-X1280PCI, made by Photron Ltd.) enabling observation of the series of droplet forming processes. FIG. 13 is a graph of a relationship between the amount of charges passing through and the volume V of the droplet 27. Referring to FIG. 13, the volume V and the amount of charges passing through is substantially proportional. It can thus be understood that the volume V of the droplet 27 can be measured from the amount of charges passing through, that is, from the integration value of the temporal waveform of the current I.

Third Embodiment

A third embodiment of the droplet forming method according to the present invention shall now be described. With this embodiment, after determining the application conditions of the pulse voltage P using the droplet forming condition determining method in the first embodiment, a sample liquid 21, having microparticles mixed therein, is dispensed under the determined application conditions to form a droplet 27, and the number of the microparticles contained in the droplet 27 is measured based on the temporal waveform of the current I that flows between the sample liquid 21 and the substrate 5.

Figure 14:
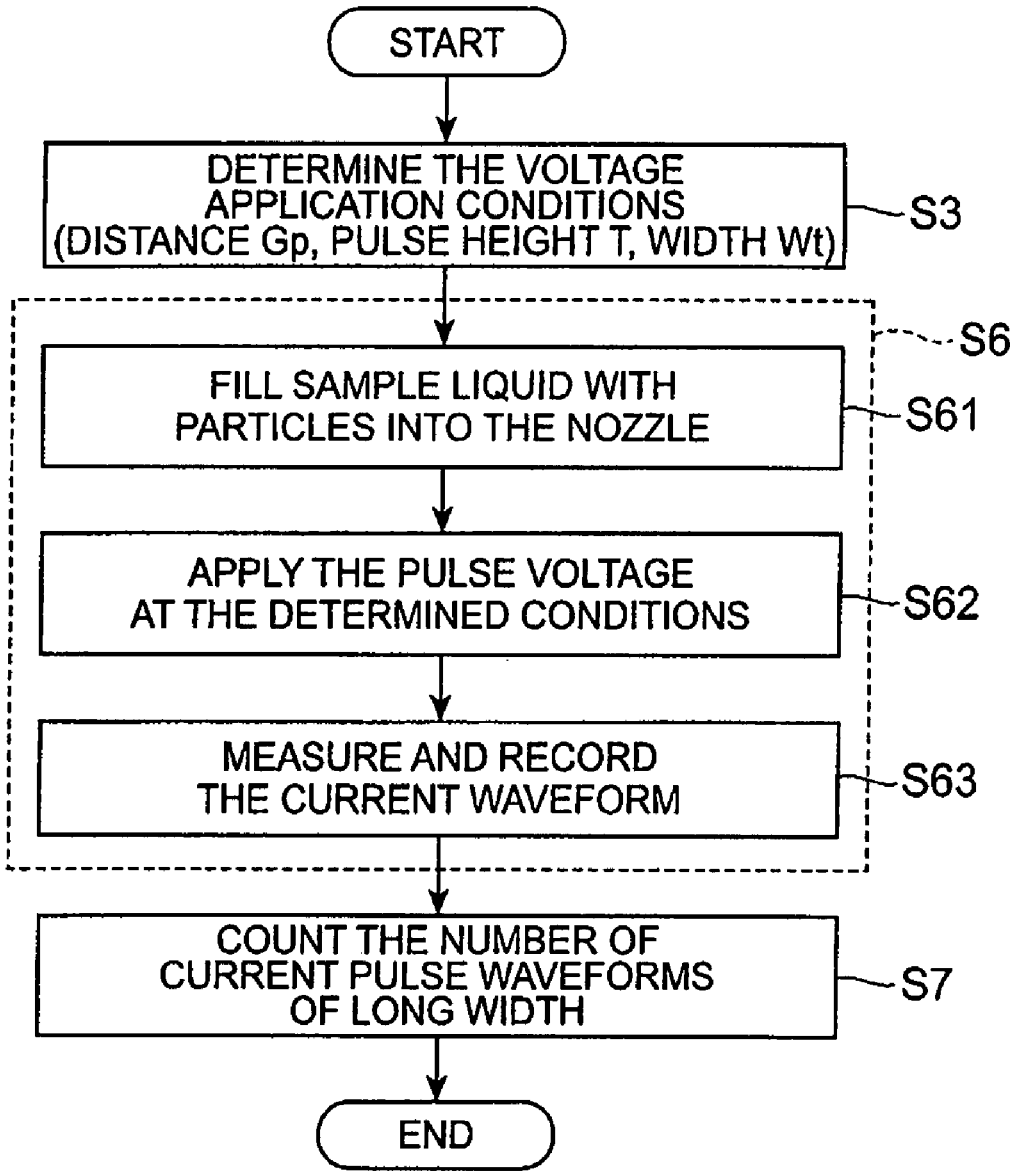
[FIG. 14] is a flowchart of a particle number measuring method according to a third embodiment.

FIG. 14 is a flowchart of the particle number measuring method according to this embodiment. First, by the droplet forming condition determining method in the first embodiment, the distance Gp between the tip of the nozzle 3 and the substrate 5, the pulse height T of the pulse voltage P, and the time width Wt of the pulse voltage P are determined (droplet forming condition determining step S3). A waveform measuring step S6 is then performed.

In this waveform measuring step S6, first, microparticles are mixed into the sample liquid 21 to prepare a particle suspension, and this particle suspension is filled into the nozzle 3 (S61). Here, yeast cells and latex particles (polymer) can be cited as examples of the microparticles. The electrical resistivity of these microparticles is higher than the resistivity of the sample liquid 21 (that is, the conductivity of the microparticles is low).

The droplet forming device 1 is then set to the respective voltage application conditions (the distance Gp, the pulse height T, and the time width Wt), determined in the droplet forming condition determining step S3, and by then applying the pulse voltage P between the particle suspension inside the nozzle 3 and the substrate 5, the particle suspension is dispensed onto the substrate 5 and the droplet 27, constituted of the particle mixture, is formed (S62). During forming of droplet 27 of the particle mixture on the substrate 5, the temporal waveform of the current I that flows between the particle mixture and the substrate 5 is measured. Specifically, the potential difference arising between respective ends of the resistor element R due to the current I is measured and recorded by the oscilloscope 15 (S63).

Then based on the temporal waveform of the current I that was measured and recorded in the waveform measuring step S6, the number of microparticles contained in the droplet 27 is measured (particle number measuring step S7). In the particle number measuring step S7, first, the number of current pulse waveforms, which, among the plurality of current pulse waveforms contained in the temporal waveform of the current I, have a pulse width that is longer than a predetermined value are counted, and this number is deemed to be the number of microparticles contained in the droplet 27.

The temporal waveform of the current I that flows between the particle suspension and the substrate 5 during transfer of the particle suspension retained in the nozzle 3 onto the substrate 5 from the tip of the nozzle 3 varies according to the movement of each individual microparticle. This phenomenon is considered to be a result of the influence of the pulse height of the observed current pulse waveform becoming small (that is, the passage of charges between the sample liquid and the substrate 5 being made difficult) when a microparticle of high resistance is contained in the jet stream 25 extending from the apex of the Taylor cone 23 at the tip of the nozzle 3 in the case where a sample liquid of comparatively high conductivity is used. Thus by observing such variations of the temporal waveform of the current I, the number of microparticles moving from the nozzle 3 onto the substrate 5 can be measured. The number of microparticles dispensed can be measured readily and with good precision by using the particle number measuring method according to this embodiment because the number of microparticles contained in the droplet 27 is measured based on the temporal waveform of the current I.

Preferably in the particle number measuring step S7, the number of microparticles contained in the droplet 27 is measured based on the number of current pulse waveforms that are longer than a predetermined value as in the present embodiment. During transfer of the particle suspension, retained in the nozzle 3, from the tip of the nozzle 3 onto the substrate 5, when a single microparticle moves from the tip of the nozzle 3 onto the substrate 5, the pulse width of the current pulse waveform arising at the instant of this movement becomes longer in comparison to that when there is no movement of microparticles. Thus with the particle number measuring method according to the embodiment, the number of microparticles contained in the droplet 27 can be measured at a higher precision.

The particle number measuring method according to this embodiment can be applied to the monitoring of microparticles contained in each droplet 27 as well as to a feedback system, in which the time width Wt of the pulse voltage P is determined based on the measurement information of the number of microparticles so that just a predetermined number of microparticles can be dispensed.

A specific example (Example 4) of this particle number measuring method shall now be described. In this Example 4, the same 3×SSC as that used in the Example 1 was used as the sample liquid 21, and yeast cells were suspended as the microparticles in the 3×SSC. As the substrate 5, the ITO substrate was used. A nozzle with an outer diameter of 33 μm and an inner diameter of 19.8 μm was used as the nozzle 3.

First, the application conditions of the pulse voltage P were determined by the droplet forming condition determining method in the above-described first embodiment. The optimal application conditions in this Example were a distance Gpo between the nozzle 3 and the ITO substrate of 10 μm, a pulse height To of the pulse voltage P of 1500V, and a time width Wt of the pulse voltage P of 150 ms.

The droplet forming device 1 was then set to the determined application conditions, the pulse voltage P was applied between the 3×SSC solution with yeast cells in the nozzle 3 and the substrate 5 to dispense the 3×SSC solution with yeast cells onto the ITO substrate and form the droplet 27, and the temporal waveform of the current I, flowing between the 3×SSC solution with yeast cells inside the nozzle 3 and the ITO substrate, was measured and recorded.

Figure 15:
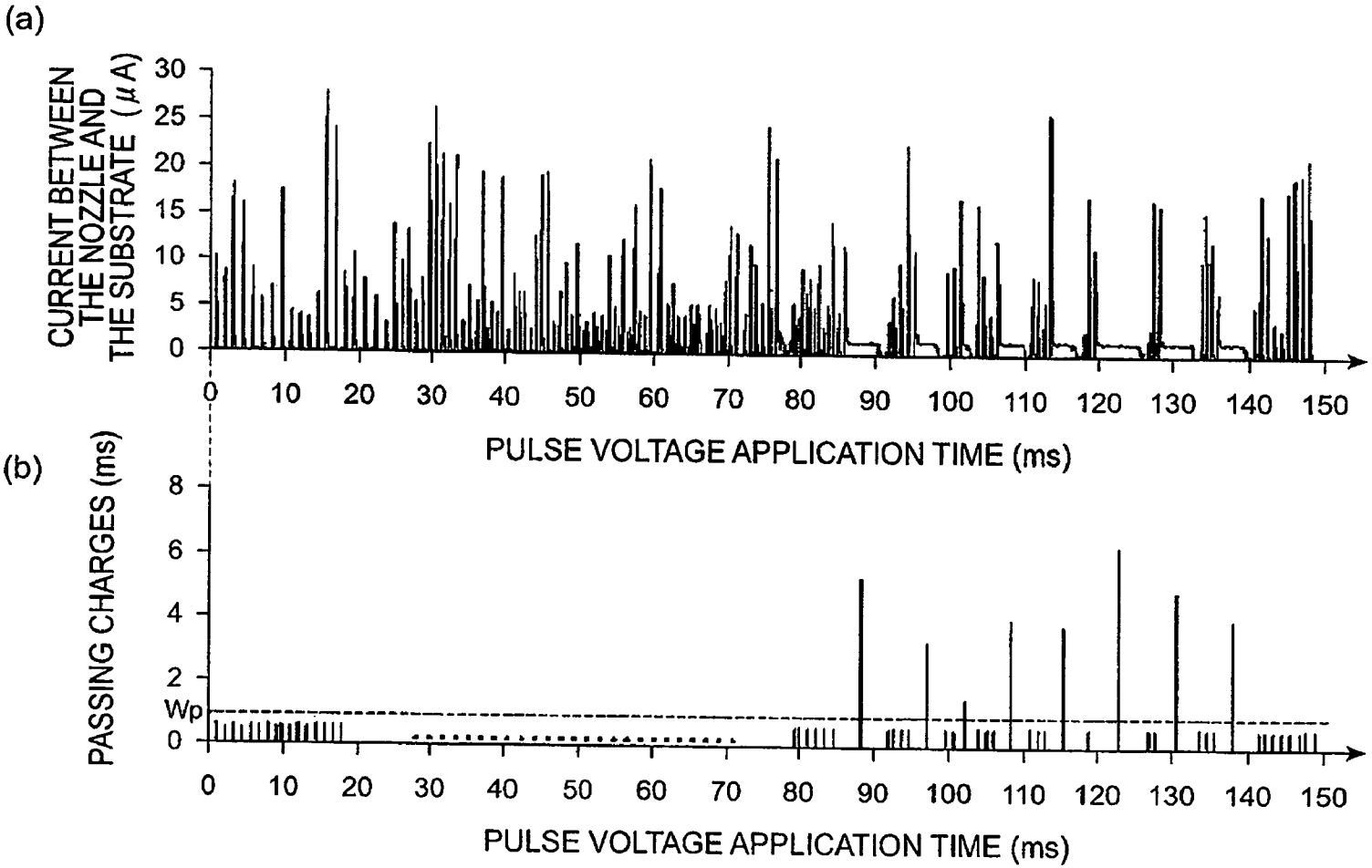
[FIG. 15] is (a) a graph of a temporal waveform of a current in an Example 4, and (b) a graph of respective pulse widths of a plurality of current pulse waveforms contained in the temporal waveform of the current shown in (a).

FIG. 15(*a*) is a graph of the temporal waveform of the current I in this Example. FIG. 15(*b*) is a graph of the respective pulse widths of the plurality of current pulse waveforms contained in the temporal waveform of the current I shown in FIG. 15(*a*). Referring to FIG. 15(*a*), it can be understood that after the elapse of 85 ms from the start of application of the pulse voltage P, the pulse widths of some of the current pulse waveforms, among the plurality of current pulse waveforms, become greater than the pulse widths of the other current pulse waveforms. Also, the pulse height of these current pulse waveforms of longer pulse widths is lower than the pulse height of the other current pulse waveforms. Each of these current pulse waveforms implies a state in which a yeast cell is contained in the jet stream 25 from the Taylor cone 23. Thus by determining the pulse widths of the respective current pulse waveforms and counting the number of current pulse waveforms having a pulse width longer than a predetermined value Wp as shown in FIG. 15(*b*), the number of yeast cells contained in the droplet 27 can be measured readily and with good precision.

Another specific example (Example 5) of this particle number measuring method shall now be described. In this Example 5, the same 3×SSC as that used in the Example 1 was used as the sample liquid 21, and latex particles (polymer) of an average particle diameter of 900 nm were suspended as the microparticles in the 3×SSC. As the substrate 5, the ITO substrate was used. A nozzle with an outer diameter of 15 μm and an inner diameter of 9 μm was used as the nozzle 3.

First, the application conditions of the pulse voltage P were determined by the droplet forming condition determining method according to the above-described first embodiment. The optimal application conditions in this Example were a distance Gpo between the nozzle 3 and the ITO substrate of 10 μm, a pulse height To of the pulse voltage P of 1500V, and a time width Wt of the pulse voltage P of 30 ms.

The droplet forming device 1 was then set to the determined application conditions, the pulse voltage P was applied between the 3×SSC with latex particles in the nozzle 3 and the substrate 5 to dispense the 3×SSC with latex particles onto the ITO substrate and form the droplet 27, and the temporal waveform of the current I, flowing between the 3×SSC with latex particles inside the nozzle 3 and the ITO substrate, was measured and recorded.

Figure 16:
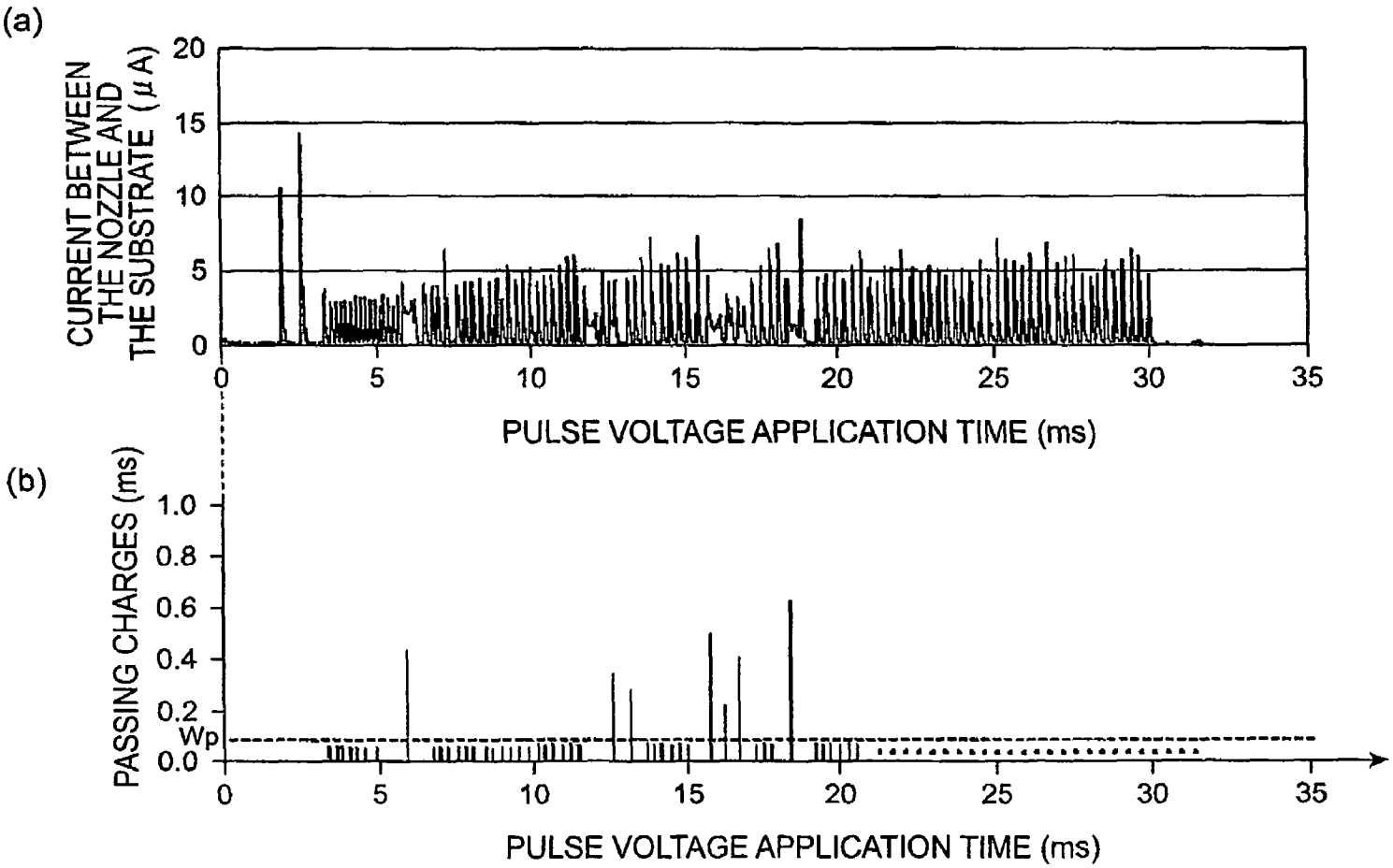
[FIG. 16] is (a) a graph of a temporal waveform of the current in an Example 5, and (b) a graph of respective pulse widths of a plurality of current pulse waveforms contained in the temporal waveform of the current shown in (a).

FIG. 16(*a*) is a graph of the temporal waveform of the current I in this Example. FIG. 16(*b*) is a graph of the respective pulse widths of the plurality of current pulse waveforms contained in the temporal waveform of the current I shown in FIG. 16(*a*). As in the above-described Example 4, it can be understood that the pulse widths of some of the current pulse waveforms, among the plurality of current pulse waveforms, are greater than the pulse widths of the other current pulse waveforms in the present Example as well. Also, the pulse height of these current pulse waveforms of longer pulse widths is lower than the pulse height of the other current pulse waveforms. Each of these current pulse waveforms implies a state in which a latex particle is contained in the jet stream 25 from the Taylor cone 23. Thus by determining the pulse widths of the respective current pulse waveforms and counting the number of current pulse waveforms having pulse width longer than the predetermined value Wp as shown in FIG. 16(*b*), the number of latex particles contained in the droplet 27 can be measured readily and with good precision.

The droplet forming method and the droplet forming device according to the present invention are not restricted to the respective embodiments and examples described above and various other modifications are possible. For example, although the XYZ stage is cited as the moving means that changes the position of the substrate in the droplet forming device according to the first embodiment described above, the moving means may be installed at the nozzle side instead. Also, although in the droplet forming device according to the first embodiment described above, the waveform analyzer performs processes up to the determination of the voltage application conditions, an operator may instead determine the voltage application conditions based on the occurrence frequency and the average pulse height of the current pulse waveforms displayed on the monitor.

INDUSTRIAL APPLICABILITY

The droplet forming method and the droplet forming device according to the present invention can be applied to various devices and methods of dispensing and using droplets.

The invention claimed is:

1. A droplet forming method comprising:

a droplet forming step of applying a pulse voltage between a liquid retained in a nozzle, and a substrate disposed opposite a tip of the nozzle, to discharge the liquid retained inside the nozzle from the tip of the nozzle and form a droplet on the substrate;

a waveform measuring step of measuring, in the droplet forming step, a temporal waveform of a current that flows between the liquid retained in the nozzle and the substrate; and an application condition determining step of determining an application condition of the pulse voltage in the droplet forming step based on the temporal waveform of the current measured in the waveform measuring step.

2. The droplet forming method according to claim 1, wherein the application condition of the pulse voltage, determined in the application condition determining step, includes at least one of a distance between the tip of the nozzle and the substrate, a pulse height of the pulse voltage, and a time width of the pulse voltage.

3. The droplet forming method according to claim 1, wherein in the application condition determining step, the application condition of the pulse voltage is determined based on an occurrence frequency of current pulse waveforms contained in the temporal waveform of the measured current.

4. The droplet forming method according to claim 1, wherein in the application condition determining step, the application condition of the pulse voltage is determined based on a pulse height of current pulse waveforms contained in the temporal waveform of the measured current.

5. The droplet forming method according to claim 1, further comprising: a volume measuring step of measuring a volume of the droplet based on an integration value of the temporal waveform of the current measured in the waveform measuring step.

6. The droplet forming method according to claim 1, wherein the liquid retained in the nozzle is a particle suspension, and the method further comprising: a particle number measuring step of measuring a number of particles contained in the droplet based on the temporal waveform of the measured current.

7. The droplet forming method according to claim 6, wherein in the particle number measuring step, the number of particles contained in the droplet is calculated based on a number of current pulse waveforms, which have a pulse width longer than a predetermined value among current pulse waveforms contained in the temporal waveform of the measured current.

8. A droplet forming device comprising:

a nozzle, retaining a liquid;

a platform, on which a substrate is set at a position opposing a tip of the nozzle;

a voltage applying means, applying a pulse voltage between the liquid retained in the nozzle, and the substrate; and a current measuring means, measuring a temporal waveform of a current, which flows between the liquid retained in the nozzle and the substrate according to the applied pulse voltage.

9. The droplet forming device according to claim 8, further comprising: a moving means that varies a relative position of the tip of the nozzle and the substrate.

10. The droplet forming device according to claim 8, further comprising: an application voltage determining means that determines on the basis of the temporal waveform of the current measured by the current measuring means, an application condition of the pulse voltage applied by the voltage applying means in a process of forming a droplet on the substrate.

11. The droplet forming device according to claim 8, further comprising: an analyzing means, analyzing the temporal waveform of the current measured by the current measuring means and determining at least one of an occurrence frequency and a pulse height of current pulse waveforms contained in the temporal waveform.

12. The droplet forming device according to claim 11, further comprising: an application voltage determining means that determines, on the basis of an analysis result of the analyzing means, an application condition of the pulse voltage applied by the voltage applying means in a process of forming a droplet on the substrate.

* * * * *